US008396716B2

(12) United States Patent
Qi et al.

(10) Patent No.: US 8,396,716 B2
(45) Date of Patent: Mar. 12, 2013

(54) SIGNAL COMPRESSION METHOD AND APPARATUS

(75) Inventors: Fengyan Qi, Shenzhen (CN); Lei Miao, Shenzhen (CN); Jianfeng Xu, Shenzhen (CN); Dejun Zhang, Shenzhen (CN); Herve Marcel Taddei, Shenzhen (CN); Qing Zhang, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 458 days.

(21) Appl. No.: 12/648,994

(22) Filed: Dec. 29, 2009

(65) Prior Publication Data

US 2010/0169086 A1 Jul. 1, 2010

(30) Foreign Application Priority Data

Dec. 30, 2008 (CN) ..... 2008 1 0247024
Jun. 25, 2009 (CN) ..... 2009 1 0149823

(51) Int. Cl.
*G10L 19/00* (2006.01)

(52) U.S. Cl. ..... 704/500; 704/217

(58) Field of Classification Search ..... 704/500, 704/217

See application file for complete search history.

(56) References Cited

U.S. PATENT DOCUMENTS

| | | | | |
|---|---|---|---|---|
| 5,403,917 | A | 4/1995 | Boos et al. | |
| 5,884,010 | A * | 3/1999 | Chen et al. | 704/228 |
| 6,240,386 | B1 | 5/2001 | Thyssen et al. | |
| 2005/0063368 | A1 | 3/2005 | Reznik | |
| 2007/0271092 | A1 | 11/2007 | Ehara et al. | |
| 2008/0215317 | A1 | 9/2008 | Fejzo | |
| 2008/0234845 | A1 | 9/2008 | Malvar | |

FOREIGN PATENT DOCUMENTS

| | | | |
|---|---|---|---|
| CN | 101609678 | B | 7/2011 |
| JP | 6142698 | A | 5/1994 |
| JP | 6-211900 | | 8/1994 |
| JP | 9-502814 | A | 3/1997 |
| JP | 2001-013999 | | 1/2001 |
| JP | 2002523806 | A | 7/2002 |
| JP | 2002-341889 | | 11/2002 |
| WO | 2006028010 | A1 | 3/2006 |
| WO | WO 2006028010 | A1 | 3/2006 |

OTHER PUBLICATIONS

Office Action issued in corresponding Korean Patent Application No. 10-2009-0132915, mailed Mar. 17, 2011.

Extended European Search Report issued in corresponding European Patent Application No. 09180886.5, mailed May 31, 2010.

So et al., "A Comparative Study of LPC Parameter Representations and Quantisation Schemes for Wideband Speech Coding" Digital Signal Processing, vol. 17, 2007.

Bäckström et al., "Effect of White-Noise Correction on Linear Predictive Coding" IEEE Signal Processing Letters, vol. 14, No. 2, Feb. 2007.

(Continued)

*Primary Examiner* — Jakieda Jackson

(57) ABSTRACT

A signal compression method includes: multiplying an input signal by a window function, calculating original autocorrelation coefficients of a windowed input signal. The method also includes calculating a white-noise correction factor or a lag-window according to the original autocorrelation coefficients, and calculating modified autocorrelation coefficients according to the original autocorrelation coefficients, the white-noise correction factor and the lag-window. The method further includes calculating linear prediction coefficients according to the modified autocorrelation coefficients, and outputting a coded bit stream according to the linear prediction coefficients.

20 Claims, 10 Drawing Sheets

OTHER PUBLICATIONS

Shannon et al., "Speech Enhancement Based on Spectral Estimation from Higher-lag Autocorrelation", Interspeech Sep. 17-21, 2006.
Kabal, "Ill-Conditioning and Bandwidth Expansion in Linear Prediction of Speech", Proc IEEE Int. Conf. Acoustics, Speech, Signal Processing (Hong Kong), pp. I-824-I-827, Apr. 2003. XP-002378183.
Cisco Systems, "G711 Lossless Compression Algorithm: Market Need, Use Cases and Design Requirements" International Telecommunication Union—Telecommunication Standardization Sector. ITU-T WP3/16, Document AC-0710-Q10-07. Geneva, Oct. 8-12, 2007.
Cisco Systems, "G711 Lossless Compression Algorithm Proposal" International Telecommunication Union—Telecommunication Standardization Sector. ITU-T WP3/16, Document AC-0710-Q10-08. Geneva, Oct. 8-12, 2007.
Liebchen et al., MPEG-4 Audio Lossless Coding Audio Engineering Society Convention Paper 6047. 116$^{th}$ Covention, Berlin, Germany, May 8-11, 2004.
Yu et al., "MPEG-4 Scalable to Lossless Audio Coding" Audio Engineering Society Convention Paper 6183. 117$^{th}$ Convention, San Francisco, CA, Oct. 28-31, 2004.
Office Action issued in corresponding Japanese Patent Application No. 2009-290579, mailed Feb. 21, 2012.
Bäckström et al., "Effect of White-Noise Correction on Linear Predictive Coding" IEEE Signal Processing Letters, vol. 14 No. 2, Feb. 2007.
Rejection decision issued in corresponding Japanese patent application JP2009-290579, Oct. 31, 2012, and an English translation thereof, total 5 pages.

* cited by examiner

SIGNAL COMPRESSION METHOD AND APPARATUS

CROSS-REFERENCE TO RELATED APPLICATIONS

This application claims priority to Chinese Patent Application No. 200810247024.1, filed on Dec. 30, 2008, and Chinese Patent Application No. 200910149823.X, filed on Jun. 25, 2009, both of which are hereby incorporated by reference in their entireties.

FIELD OF THE DISCLOSURE

The present disclosure relates to audio compression, and in particular, to a signal compression method and apparatus.

BACKGROUND OF THE DISCLOSURE

To save the bandwidth for transmitting and storing speech and audio signals, the speech and audio coding technologies are applied widely. Currently, these coding technologies are mainly classified into lossy coding and lossless coding technologies.

Linear prediction (LP) analysis is widely applied in lossless compression coding to reduce the dynamic range of input signals and to remove the redundancy of the near sample points of signals, but bandwidth expansion is not generally applied in lossless coding.

In G.729, which is a lossy coding, a bandwidth expansion technology is applied by multiplying the autocorrelation coefficients with a lag-window. A 60 Hz bandwidth expansion is performed before calculating the LP coefficients by a Levinson-Durbin algorithm, with a view to making the LP analysis more stable. The steps of calculating the LP coefficients in the prior art are as follows:

1. Multiply input signals by a window function, and calculate the autocorrelation coefficients: r(0), r(1) . . . r(p), where p is the order of LP.

2. Calculate the weighting factor $win_{lag}$ of the autocorrelation coefficients:

$$win_{lag}(k) = \exp\left[-\frac{1}{2}\left(\frac{2\pi f_0 k}{f_s}\right)^2\right] \quad k = 1, \ldots, p,$$

where $f_0$ is a constant such as $f_0$=60 Hz; $f_s$ is a signal sampling frequency such as 8000 Hz; and p is the order (such as 10) of LP analysis.

3. Determine that the white-noise correction factor is $win_{lag}(0)=1.0001$.

4. Calculate the adjusted autocorrelation coefficients:

$$r(0)' = win_{lag}(0)r(0)$$

$$r(k)' = win_{lag}(k)r(k) \quad k=1, \ldots, p$$

5. Use the adjusted autocorrelation coefficients to calculate the new LP coefficients through a Levinson-Durbin algorithm.

In the prior art, every frame signal is processed in the same way.

LP analysis is widely applied in lossless coding to reduce the dynamic range of input signals and to remove the redundancy of the near sample points of signals.

In the process of implementing the present disclosure, there are at least these defects in the prior art: because all signals are processed in the same way, ill-conditioned case may occur for some special input signals, and the solving of the autocorrelation matrix is instable, which leads to low compression efficiency of a lossless coder and low quality of reconstructed speech signals of a lossy coder.

SUMMARY

A signal compression method includes:

multiplying an input signal by a window function;

calculating original autocorrelation coefficients of a windowed input signal;

adjusting autocorrelation coefficient correction factors according to the original autocorrelation coefficients;

calculating modified autocorrelation coefficients according to the original autocorrelation coefficients and the adjusted autocorrelation coefficient correction factors;

calculating linear prediction coefficients according to the modified autocorrelation coefficients; and coding the input signal according to the linear prediction coefficients, and outputting a coded bit stream.

Another signal compression method includes:

multiplying an input signal by a window function;

calculating original autocorrelation coefficients of a windowed input signal;

calculating an energy parameter according to the first coefficient of the original autocorrelation coefficients, and adjusting a white-noise correction factor according to the energy parameter;

calculating a lag-window according to an expansion bandwidth;

calculating modified autocorrelation coefficients according to the original autocorrelation coefficients, an adjusted white-noise correction factor, and the lag-window;

calculating linear prediction coefficients according to the modified autocorrelation coefficients; and performing linear prediction for the input signal according to the linear prediction coefficients, calculating a residual signal, coding the residual signal, and outputting a coded bit stream.

A signal compression apparatus includes:

a windowing unit, configured to multiply an input signal by a window function;

an original autocorrelation coefficients calculating unit, configured to calculate the original autocorrelation coefficients of an input signal processed by the windowing unit;

a bandwidth expanding unit, configured to adjust autocorrelation coefficient correction factors according to the original autocorrelation coefficients calculated by the original autocorrelation coefficients calculating unit, and calculate modified autocorrelation coefficients according to the original autocorrelation coefficients and the adjusted autocorrelation coefficient correction factors;

a linear prediction coefficients calculating unit, configured to calculate the linear prediction coefficients according to the modified autocorrelation coefficients calculated by the bandwidth expanding unit; and a compressing unit, configured to code the input signal according to the linear prediction coefficients calculated by the linear prediction coefficients calculating unit, and output a coded bit stream.

In the technical solution under embodiments of the present disclosure, the autocorrelation coefficient correction factors are adjusted according to the original autocorrelation coefficients so that the adjusted autocorrelation coefficient correction factors can express the difference of input signals, thereby avoiding ill-conditioned cases of special input signals, making the modified autocorrelation coefficients more suitable for subsequent compression processing, improving the compression efficiency of a lossless coder and the quality of reconstructed speech signals of a lossy coder, and involving only simple operations.

BRIEF DESCRIPTION OF THE DRAWINGS

The accompanying drawings are intended for better understanding of the present disclosure and constitute part of this application rather than a limitation on the present disclosure.

DETAILED DESCRIPTION OF THE DISCLOSURE

To make the technical solution, objectives and merits of the present disclosure clear, the following describes the present disclosure in detail with reference to the accompanying drawings and exemplary embodiments. The exemplary embodiments of the present disclosure and the description thereof are intended for interpreting rather than limiting the present disclosure.

The embodiments of the present disclosure provide a signal compression method and apparatus. The embodiments of the present disclosure are detailed below with reference to the accompanying drawings.

First Embodiment

Figure 1:
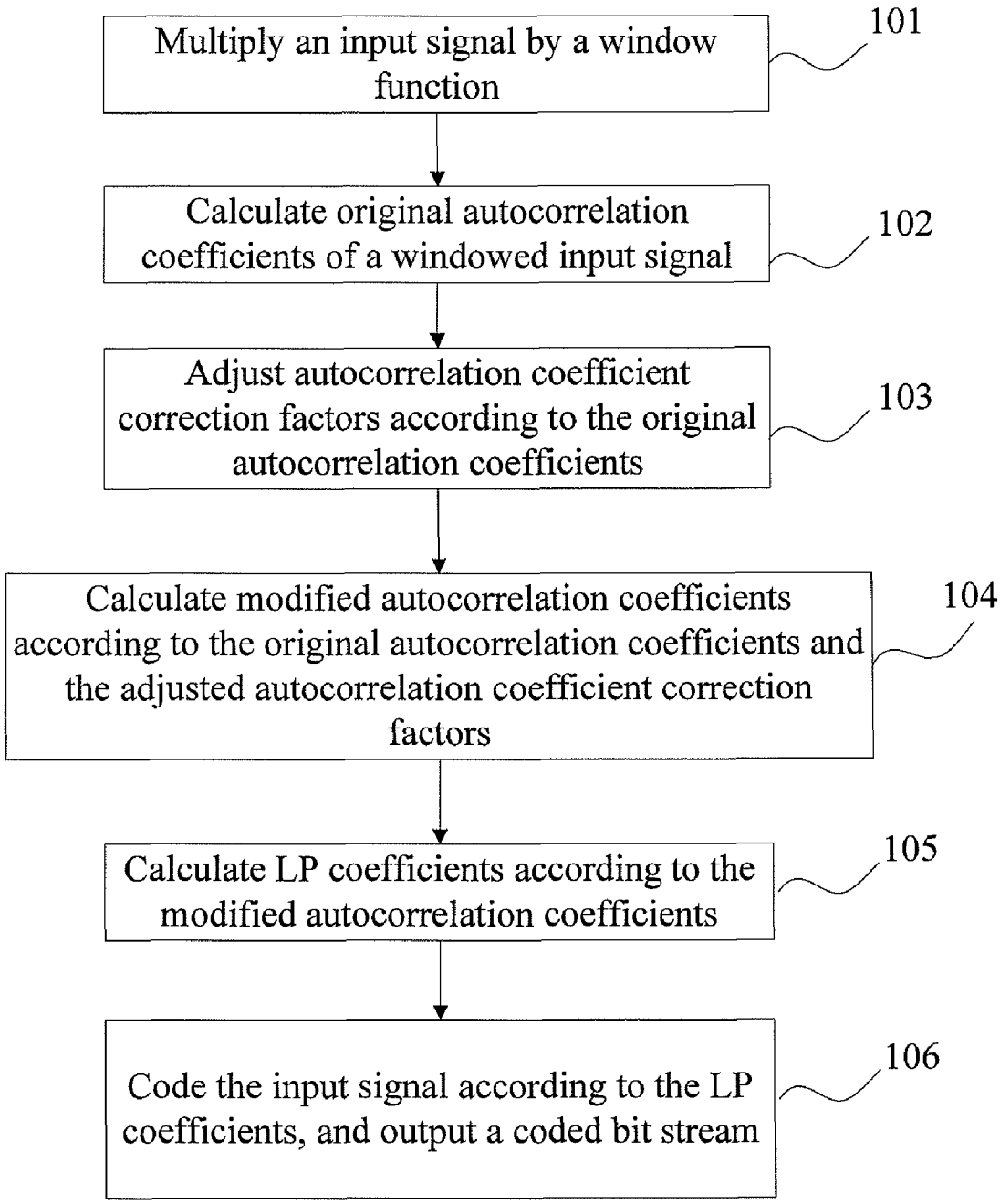
FIG. 1 is a flowchart of a signal compression method in the first embodiment of the present disclosure.

FIG. 1 is a flowchart of a signal compression method in the first embodiment of the present disclosure. The method includes the following steps:

Step 101: Multiply an input signal by a window function.

Step 102: Calculate original autocorrelation coefficients of a windowed input signal.

Step 103: Adjust autocorrelation coefficient correction factors according to the original autocorrelation coefficients.

Step 104: Calculate modified autocorrelation coefficients according to the original autocorrelation coefficients and the adjusted autocorrelation coefficient correction factors.

The autocorrelation coefficient correction factors include a white-noise correction factor and a lag-window. Adjusting the autocorrelation coefficient correction factors may be: adjusting the white-noise correction factor and the lag-window, or adjusting the white-noise correction factor only, or adjusting the lag-window only.

Adjusting the autocorrelation coefficient correction factors according to the original autocorrelation coefficients may be: determining characteristic parameters of the input signal according to the original autocorrelation coefficients and adjusting the autocorrelation coefficient correction factors according to the characteristic parameters. The characteristic parameters may be: energy, periodicity parameter, zero crossing rate, or reflection coefficient, or any combination thereof; and may be extracted from original input signals or signals obtained in any step.

Step 105: Calculate LP coefficients according to the modified autocorrelation coefficients.

Step 106: Code the input signal according to the LP coefficients, and output a coded bit stream.

Coding the input signal according to the LP coefficients may be: performing LP analysis for the input signal according to the LP coefficients, calculating a residual signal, and then performing Long Term Prediction (LTP) and entropy coding, and finally, outputting a lossless coded bit stream of the residual signal; or, inputting the LP coefficients and the input signal into the Code Excited Linear Prediction (CELP) model to obtain the bit stream.

In another embodiment of the present disclosure, a preprocessing step may be included. Before step 101, the input signal is preprocessed. For lossy compression, the preprocessing may be a pre-emphasis filtering or a high-pass filtering for increasing the high-frequency components of the input signal or filtering out unnecessary low-frequency interference components. Afterward, the filtered signal is windowed according to step 101. For lossless compression, the preprocessing may be a mapping operation; that is, the input signal is mapped from the A-law or μ-law to the Pulse Coding Modulation (PCM) domain. The signals in the PCM domain are more suitable for LP short-term prediction.

With the technical solution in the foregoing embodiment, the original autocorrelation coefficients reflect the characteristics of each frame signal; according to such characteristics, the autocorrelation coefficient correction factors are adjusted so that the adjusted autocorrelation coefficient correction factors are determined according to the characteristics of each frame signal. Therefore, the LP coefficients fit in with the characteristics of the signals more accurately; ill-conditioned cases are avoided; the calculated coefficients are more robust; and the calculation complexity is low.

Second Embodiment

Figure 2:
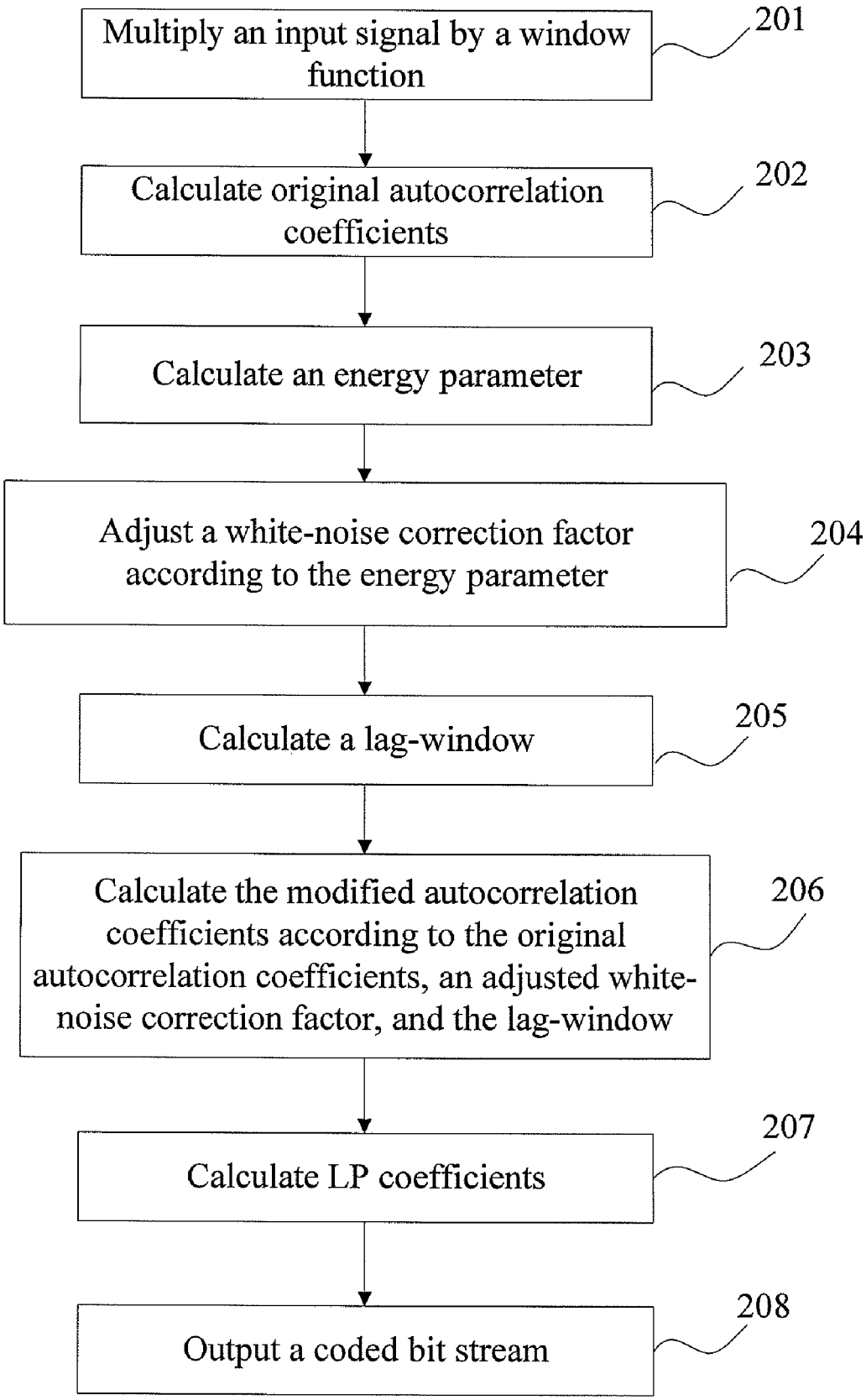
FIG. 2 is a flowchart of a signal compression method in the second embodiment of the present disclosure.

FIG. 2 is a flowchart of a signal compression method in the second embodiment of the present disclosure. The method includes the following steps:

Step 201: Multiply an input signal by a window function. The window here may be the window applied to lossy coding in the prior art. The input signal s(n) is multiplied by the window function win(n) to obtain a windowed input signal s'(n):

$$s'(n)=\mathrm{win}(n)s(n)\ n=0,\ldots N-1,$$ where N is the frame length.

Step 202: Calculate original autocorrelation coefficients r(k) ac cording to the windowed input signal s' (n), for example, through the following formula:

$$r(k) = \sum_{n=k}^{N-1} s'(n)s'(n-k) \quad k = 0, \ldots, p,$$

k=0, . . . p, where p is the order of LP.

Step 203: Calculate an energy parameter E according to the original autocorrelation coefficients.

In some embodiments, the frame average energy may be calculated according to the first coefficient r(0) of the original autocorrelation coefficients:

Ener_avg=$r(0)/N$, where N is the frame length.

In other embodiments, the frame energy parameter may be calculated according to the first coefficient r(0) of the original autocorrelation coefficients:

Ener=30−$\lfloor \log_2 r(0) \rfloor$, where $\lfloor x \rfloor$ refers to rounding down, namely, $\lfloor x \rfloor = \max\{n \in \{\ldots, -2, -1, 0, 1, 2, \ldots\} | x \geqq n\}$.

Step 204: Adjust a white-noise correction factor according to the energy parameter.

In this embodiment, an energy threshold $E_{thr}$ may be set. According to the relationship between the energy parameter E and the $E_{thr}$, the input signals are differentiated. Different adjustment functions are used to adjust the white-noise correction factor for different input signals. Specifically, different adjustment functions are used to adjust the white-noise correction factor according to different energy threshold intervals in which the energy parameter ranges according to the following equation:

$$win_{lag}(0) = \begin{cases} \text{function_1}(r(0)); & E \in [0, E_{thr1}] \\ \text{function_2}(r(0)); & E \in [E_{thr1}, E_{thr2}] \\ \vdots & \\ \text{function_n}(r(0)); & E \in [E_{thr(n-1)}, E_{thrn}] \end{cases}$$

In some embodiments, the frame signals are categorized into high-energy frame signals and low-energy frame signals according to the frame average energy Ener_avg and the energy threshold $E_{thr}$, and then the white-noise correction factor $win_{lag}(0)$ is adjusted accordingly:

if (Ener_avg>=$E_{thr}$)

$win_{lag}(0)=H+\alpha$*Ener_avg;

else $win_{lag}(0)=L+\beta$*Ener_avg;

The energy threshold $E_{thr}$ is determined as a constant that can differentiate between unvoiced and voiced speech by plenty of speech corpora. For example, $E_{thr}$=1638, which is approximately 32 dB. H, L, α, β are empirical constants, and may be obtained through training by using representative training data, and the training is benchmarked against the final coder performance. For example, H=1.001, L=1.002, $\alpha=\beta=-6\times10^{-7}$.

In other embodiments, the frame signals are categorized into high-energy frame signals and low-energy frame signals according to the frame energy parameter Ener and the energy threshold $E_{thr}$, and then the white-noise correction factor $win_{lag}(0)$ is adjusted accordingly:

if (Ener<$E_{thr}$)

$win_{lag}(0)=L+\beta$*(Ener+$E_{thr}$);

else $win_{lag}(0)=H+\alpha$*(Ener+$E_{thr}$);

The energy threshold $E_{thr}$ is determined as a constant that can differentiate between unvoiced and voiced speech by plenty of speech corpora. Considering the impact from the frame length, different energy thresholds may be set for different frame lengths, for example, $$E_{thr} = \begin{cases} 13 & N = 160 \\ 12 & N = 240,320. \end{cases}$$

H, L, α, β are empirical constants, and may be obtained through training by using representative training data, and the training is benchmarked against the final coder performance. For example, H=1.0028, L=1.0018, $\alpha=\beta=-2^{-14}$.

Step 205: Calculate a lag-window $win_{lag}(k)$ according to an expansion bandwidth $f_0$:

$$win_{lag}(k) = \exp\left[-\frac{1}{2}\left(\frac{2\pi f_0 k}{f_s}\right)^2\right] \quad k = 1, \ldots, p,$$

where $f_0$ is the expansion bandwidth such as 34 Hz; $f_s$ is a signal sampling frequency such as 8000 Hz; and p is the order of LP.

Step 206: According to the original autocorrelation coefficients r(k), an adjusted white-noise correction factor $win_{lag}(0)$ and the lag-window $win_{lag}(k)$, calculate the modified autocorrelation coefficients r(0)' . . . r(k)' after the autocorrelation coefficient correction factors are adjusted:

$r(0)'=win_{lag}(0)r(0)$ $r(k)'=win_{lag}(k)r(k)$ $k=1, \ldots, p$

Step 207: Use the modified autocorrelation coefficients r(0)' . . . r(k)' to calculate LP coefficients through a Levinson-Durbin algorithm.

Step 208: Code the input signal according to the LP coefficients, and output a coded bit stream. Performing the compression coding for the input signal according to the LP coefficients may be: calculating a residual signal of the input signal through LP analysis, and then performing LTP and entropy coding, and finally, outputting a lossless coded bit stream of the residual signal; or, inputting the LP coefficients and the input signal into the CELP model to obtain a coded bit stream.

With the technical solution in this embodiment, the energy parameter that indicates the characteristics of the input signal is calculated through the original autocorrelation coefficients; according to the energy parameter, the white-noise correction factor is adjusted so that the adjusted autocorrelation coefficient correction factors are determined according to the characteristics of each frame signal. Therefore, the LP coefficients fit in with the characteristics of the signals more accurately; ill-conditioned cases are avoided; the calculated coefficients are more robust; and the calculation complexity is low.

Third Embodiment

Figure 3:
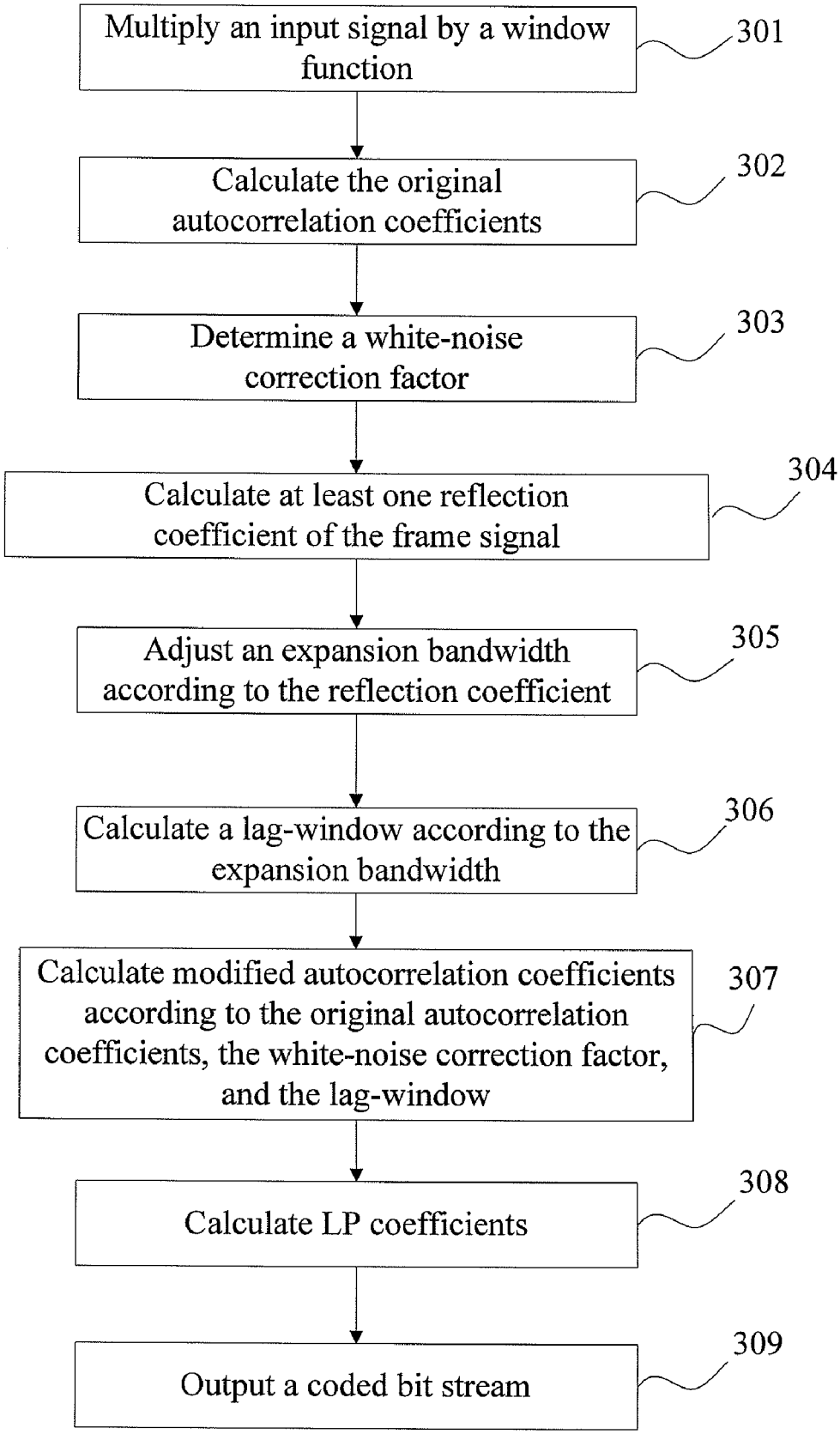
FIG. 3 is a flowchart of a signal compression method in the third embodiment of the present disclosure.

FIG. 3 is a flowchart of a signal compression method in the third embodiment of the present disclosure. The method includes the following steps:

Step 301: Multiply an input signal by a window function. The window here may be the window applied to lossy coding in the prior art. The input signal s(n) is multiplied by the window function win(n) to obtain a windowed input signal s'(n):

$s'(n)=\mathrm{win}(n)s(n)\ n=0, \ldots N-1$, where N is the frame length.

Step 302: Calculate the original autocorrelation coefficients r(k) according to the windowed input signal s'(n), for example, through the following formula:

$$r(k)=\sum_{n=k}^{N-1} s'(n)s'(n-k)\ k=0, \ldots, p,$$

where p is the order of LP.

Step 303: Determine a white-noise correction factor to be $\mathrm{win}_{lag}(0)=1.0001$.

Step 304: Calculate at least one reflection coefficient of the windowed input signal according to the original autocorrelation coefficients. In this embodiment, only the first reflection coefficient is calculated to simplify the calculation, but the present disclosure is not limited to calculate only the first reflection coefficient. The reflection coefficient may be calculated through the Levinson-Durbin recursive algorithm:

$$\begin{aligned}
&E^{[0]} = r(0)\\
&\text{for } i = 1 \text{ to } p\\
&\quad a_0^{[i-1]} = 1\\
&\quad k_i' = -\left[\sum_{j=0}^{i-1} a_j^{[i-1]} r(i-j)\right] \Big/ E^{[i-1]}\\
&\quad a_i^{[i]} = k_i'\\
&\quad \text{for } j = 1 \text{ to } i-1\\
&\quad\quad a_j^{[i]} = a_j^{[i-1]} + k_i' a_{i-j}^{[i-1]}\\
&\quad \text{end}\\
&\quad E^{[i]} = (1-k_i'^2)E^{[i-1]}\\
&\text{end}
\end{aligned}$$

Through this recursive algorithm, the $k_i=-k_i'$ $i=1, \ldots, p$ is calculated, where:

$k_1=r(1)/r(0)$.

Step 305: According to the at least one reflection coefficient, for example $k_1$, adaptively calculate and adjust an expansion bandwidth $f_0$:

$f_0=F+\alpha k_1$, where F may be a constant such as 60 Hz, and $\alpha$ is a regulating expansion factor which may be obtained through the training by using representative training data, where the training is benchmarked against the final coder performance. For example, $\alpha=10$.

Step 306: Calculate a lag-window according to the expansion bandwidth $f_0$:

$$win_{lag}(k)=\exp\left[-\frac{1}{2}\left(\frac{2\pi f_0 k}{f_s}\right)^2\right]\ k=1, \ldots, p,$$

where $f_0$ is the expansion bandwidth calculated in step 305; $f_s$ is a signal sampling frequency such as 8000 Hz; and p is the order of LP.

Step 307: According to the original autocorrelation coefficients r(k), the white-noise correction factor $\mathrm{win}_{lag}(0)$ and the lag-window $\mathrm{win}_{lag}(k)$, calculate modified autocorrelation coefficients r(0)' . . . r(k)' after the autocorrelation coefficient correction factors are adjusted:

$r(0)'=\mathrm{win}_{lag}(0)r(0)$ $r(k)'=\mathrm{win}_{lag}(k)r(k)\ k=1, \ldots, p$ Step 308: Use the modified autocorrelation coefficients r(0)' . . . r(k)' to calculate LP coefficients through a Levinson-Durbin algorithm.

Step 309: Code the input signal according to the LP coefficients, and output a coded bit stream. Coding the input signal according to the LP coefficients may be: inputting the LP coefficients and the input signal into the CELP model to obtain a coded bit stream; or, calculating a residual signal of the input signal through LP analysis, and then performing LTP and entropy coding, and finally, outputting a lossless coded bit stream of the residual signal.

With the technical solution in this embodiment, the reflection coefficient that indicates the characteristics of the input signal is calculated according to the original autocorrelation coefficients. The expansion bandwidth is determined according to the reflection coefficient, and the lag-window is adjusted according to the determined expansion bandwidth. In this way, the adjusted autocorrelation coefficient correction factors are determined according to the characteristics of each frame signal. Therefore, the LP coefficients fit in with the characteristics of the signals more accurately; ill-conditioned cases are avoided; the calculated coefficients are more robust; and the calculation complexity is low.

Fourth Embodiment

Figure 4:
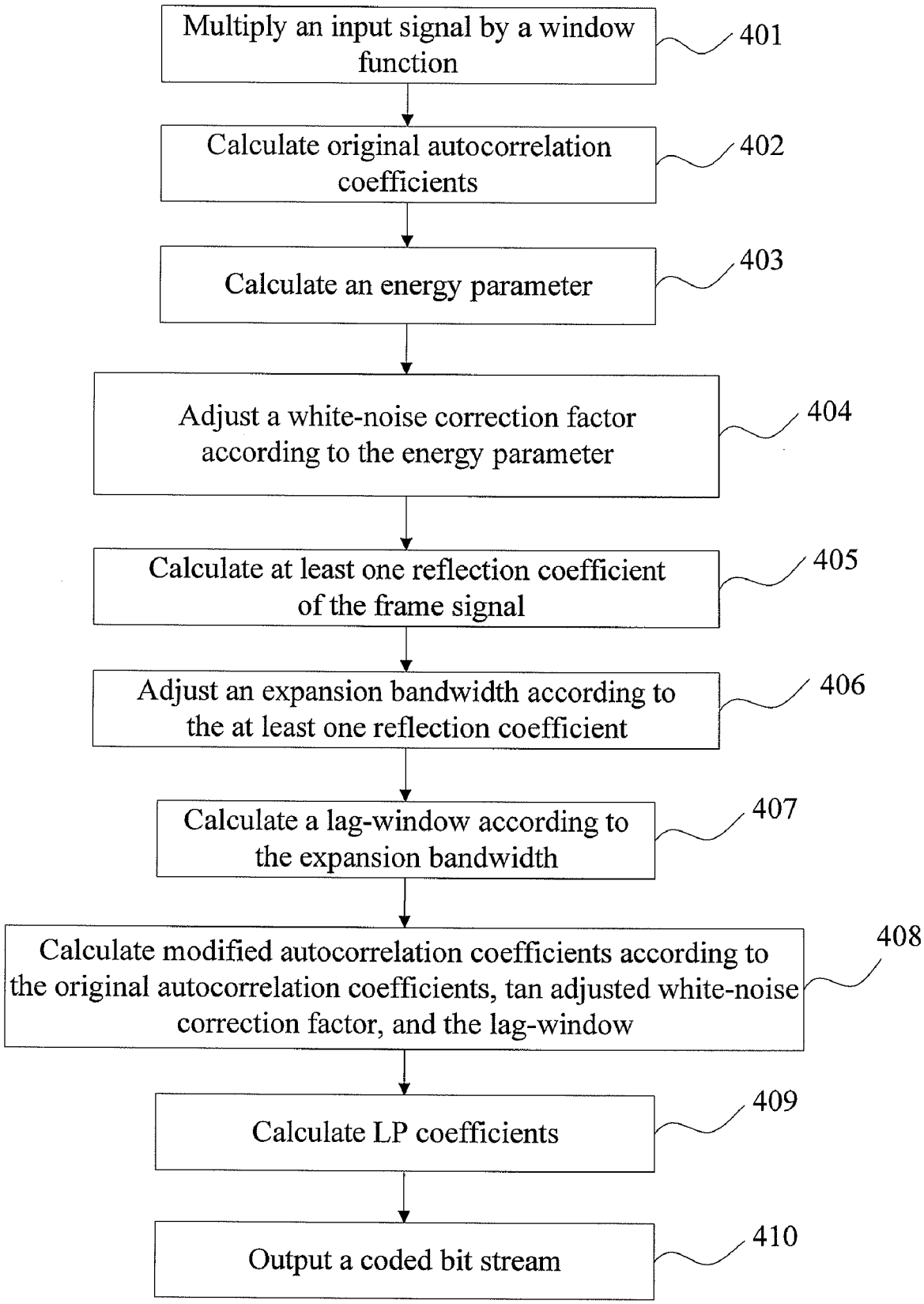
FIG. 4 is a flowchart of a signal compression method in the fourth embodiment of the present disclosure.

FIG. 4 is a flowchart of a signal compression method in the fourth embodiment of the present disclosure. The method includes the following steps:

Step 401: Multiply an input signal by a window function. The window here may be the window applied to lossy coding in the prior art. The input signal s(n) is multiplied by the window function win(n) to obtain a windowed input signal s' (n):

$s'(n)=\mathrm{win}(n)s(n)\ n=0, \ldots N-1$, where N is the frame length.

Step 402: Calculate original autocorrelation coefficients r(k) ac cording to the windowed input signal s'(n), for example, through the following formula:

$$r(k)=\sum_{n=k}^{N-1} s'(n)s'(n-k)\ k=0, \ldots, p,$$

where p is the order of LP.

Step 403: Calculate an energy parameter according to the original autocorrelation coefficients.

In some embodiments, the frame average energy may be calculated according to the first coefficient r(0) of the original autocorrelation coefficients:

$\mathrm{Ener_avg}=r(0)/N$, where N is the frame length.

In other embodiments, the frame energy parameter may be calculated according to the first coefficient r(0) of the original autocorrelation coefficients:

$\mathrm{Ener}=30-\lfloor \log_2[r(0)] \rfloor$, where $\lfloor x \rfloor$ refers to rounding down, namely, $\lfloor x \rfloor=\max\{n \in \{\ldots, -2, -1, 0, 1, 2, \ldots\} | x \geqq n\}$.

Step 404: Adjust a white-noise correction factor according to the energy parameter.

In this embodiment, an energy threshold $E_{thr}$ may be set. According to the relationship between the energy parameter E and the $E_{thr}$, the input signals are differentiated. Different adjustment functions are used to adjust the white-noise correction factor for different input signals. Specifically, different adjustment functions are used to adjust the white-noise correction factor according to different energy threshold intervals that in which the energy parameter ranges:

$$win_{lag}(0) = \begin{cases} \text{function_1}(r(0)); & E \in [0, E_{thr1}] \\ \text{function_2}(r(0)); & E \in [E_{thr1}, E_{thr2}] \\ \vdots & \\ \text{function_n}(r(0)); & E \in [E_{thr(n-1)}, E_{thrn}] \end{cases}$$

In some embodiments, the frame signals are categorized into high-energy frame signals and low-energy frame signals according to the frame average energy Ener_avg and the energy threshold $E_{thr}$, and then the white-noise correction factor $win_{lag}(0)$ is adjusted accordingly:

if(Ener_avg>=$E_{thr}$)

$win_{lag}(0)=H+\alpha$*Ener_avg;

else $win_{lag}(0)=L+\beta$*Ener_avg;

where $E_{thr}$, H, L, α, β are empirical constants, which may be obtained according to the specific conditions.

In other embodiments, the frame signals are categorized into high-energy frame signals and low-energy frame signals according to the frame energy parameter Ener and the energy threshold $E_{thr}$, and then the white-noise correction factor $win_{lag}(0)$ is adjusted accordingly:

if(Ener<$E_{thr}$)

$win_{lag}(0)=L+\beta$*(Ener+$E_{thr}$);

else $win_{lag}(0)=H+\alpha$*(Ener+$E_{thr}$);

where $E_{thr}$, H, L, α, β are empirical constants that may be obtained according to the specific conditions.

Step 405: Calculate at least one reflection coefficient of the windowed input signal according to the original autocorrelation coefficients. In this embodiment, only the first reflection coefficient is calculated to simplify the calculation, but the present disclosure is not limited to calculate only the first reflection coefficient.

$$k_1=r(1)/r(0).$$

Step 406: According to the at least one reflection coefficient, for example $k_1$, adaptively calculate and adjust an expansion bandwidth $f_0$:

$f=F+\alpha k_1$, where F may be a constant such as 60 Hz, and α is a regulating expansion factor which may be obtained through training by using representative training data, and the training is benchmarked against the final coder performance. For example, α=10.

Step 407: Calculate a lag-window according to the expansion bandwidth $f_0$:

$$win_{lag}(k) = \exp\left[-\frac{1}{2}\left(\frac{2\pi f_0 k}{f_s}\right)^2\right] \quad k = 1, \ldots, p$$

where $f_0$ is the expansion bandwidth calculated in step 406; $f_s$ is a signal sampling frequency such as 8000 Hz; and p is the order of LP.

Step 408: According to the original autocorrelation coefficients r(k), an adjusted white-noise correction factor $win_{lag}(0)$ and the lag-window $win_{lag}(k)$, calculate modified autocorrelation coefficients after the autocorrelation coefficient correction factors are adjusted:

$$r(0)'=win_{lag}(0)r(0)$$

$$r(k)'=win_{lag}(k)r(k) \quad k=1, \ldots, p$$

Step 409: Use the modified autocorrelation coefficients r(0)' . . . r(k)' to calculate LP coefficients through a Levinson-Durbin algorithm.

Step 410: Code the input signal according to the LP coefficients, and output a coded bit stream. Coding the input signal according to the LP coefficients may be: calculating a residual signal of the input signal through LP analysis, and then performing LTP and entropy coding, and finally, outputting a lossless coded bit stream of the residual signal; or, inputting the LP coefficients and the input signal into the CELP model to obtain a coded bit stream.

With the technical solution in this embodiment, the energy parameter and the reflection coefficient that indicates the characteristics of the input signal are calculated according to the original autocorrelation coefficients. The white-noise correction factor is adjusted according to the energy parameter. The expansion bandwidth is determined according to the reflection coefficient, and the lag-window is adjusted according to the determined expansion bandwidth. In this way, the adjusted autocorrelation coefficient correction factors are determined according to the characteristics of each frame signal. Therefore, the LP coefficients fit in with the characteristics of the signals more accurately; ill-conditioned cases are avoided; the calculated coefficients are more robust; and the calculation complexity is low.

Fifth Embodiment

Figure 5:
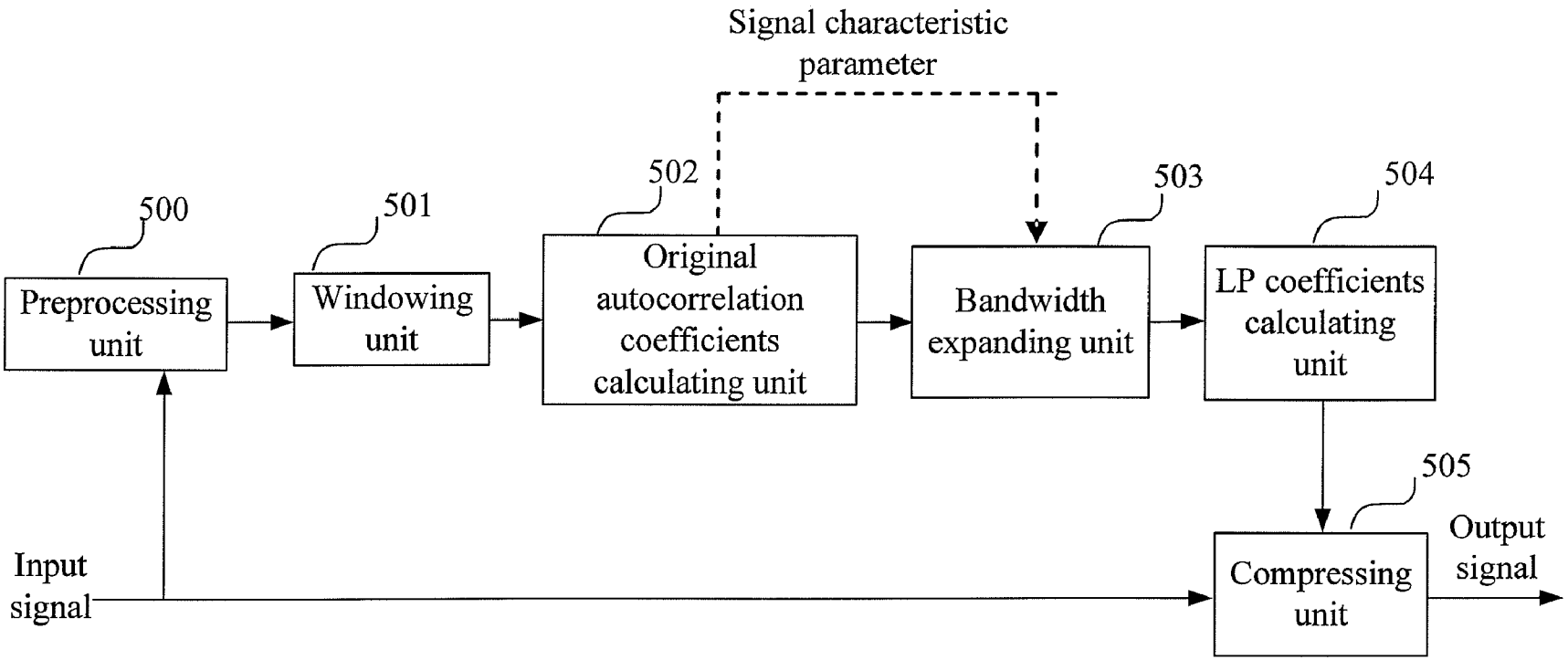
FIG. 5 shows a structure of a signal compression apparatus in the fifth embodiment of the present disclosure.

FIG. 5 shows a structure of a signal compression apparatus in the fifth embodiment of the present disclosure. The apparatus includes:

a windowing unit 501, configured to multiply an input signal by a window function;

an original autocorrelation coefficients calculating unit 502, configured to calculate the original autocorrelation coefficients of an input signal processed by the windowing unit 501;

a bandwidth expanding unit 503, configured to adjust autocorrelation coefficient correction factors according to the original autocorrelation coefficients calculated by the original autocorrelation coefficients calculating unit 502, and calculate modified autocorrelation coefficients according to the original autocorrelation coefficients and the adjusted autocorrelation coefficient correction factors;

a linear prediction coefficients calculating unit 504, configured to calculate the LP coefficients according to the modified autocorrelation coefficients calculated by the bandwidth expanding unit 503; and a compressing unit 505, configured to code the input signal according to the LP coefficients calculated by the linear prediction coefficients calculating unit 504, and output a coded bit stream.

In another embodiment of the present disclosure, the apparatus may further include a preprocessing unit 500, which is configured to preprocess the input signal for different types of compression, and send a preprocessed input signal to the windowing unit 501 to make the input signal more suitable for being processed by subsequent modules. For lossy compression, the preprocessing unit may be a pre-emphasis filtering or a high-pass filter which is configured to increase the high-frequency components of the input signal or to filter out unnecessary low-frequency interference components. Afterward, the filtered signal is input into the windowing unit 501. For lossless compression, the preprocessing unit may be a mapping module which maps the input signal from the A-law or μ-law to the PCM domain. The signals in the PCM domain are more suitable for LP short-term prediction.

With the technical solution in the foregoing embodiment, the original autocorrelation coefficients reflect the characteristics of each frame signal; according to such characteristics, the autocorrelation coefficient correction factors are adjusted so that the adjusted autocorrelation coefficient correction factors are determined according to the characteristics of each frame signal. Therefore, the LP coefficients fit in with the characteristics of the signals more accurately; ill-conditioned cases are avoided; the calculated coefficients are more robust; and the calculation complexity is low.

Sixth Embodiment

Figure 6:
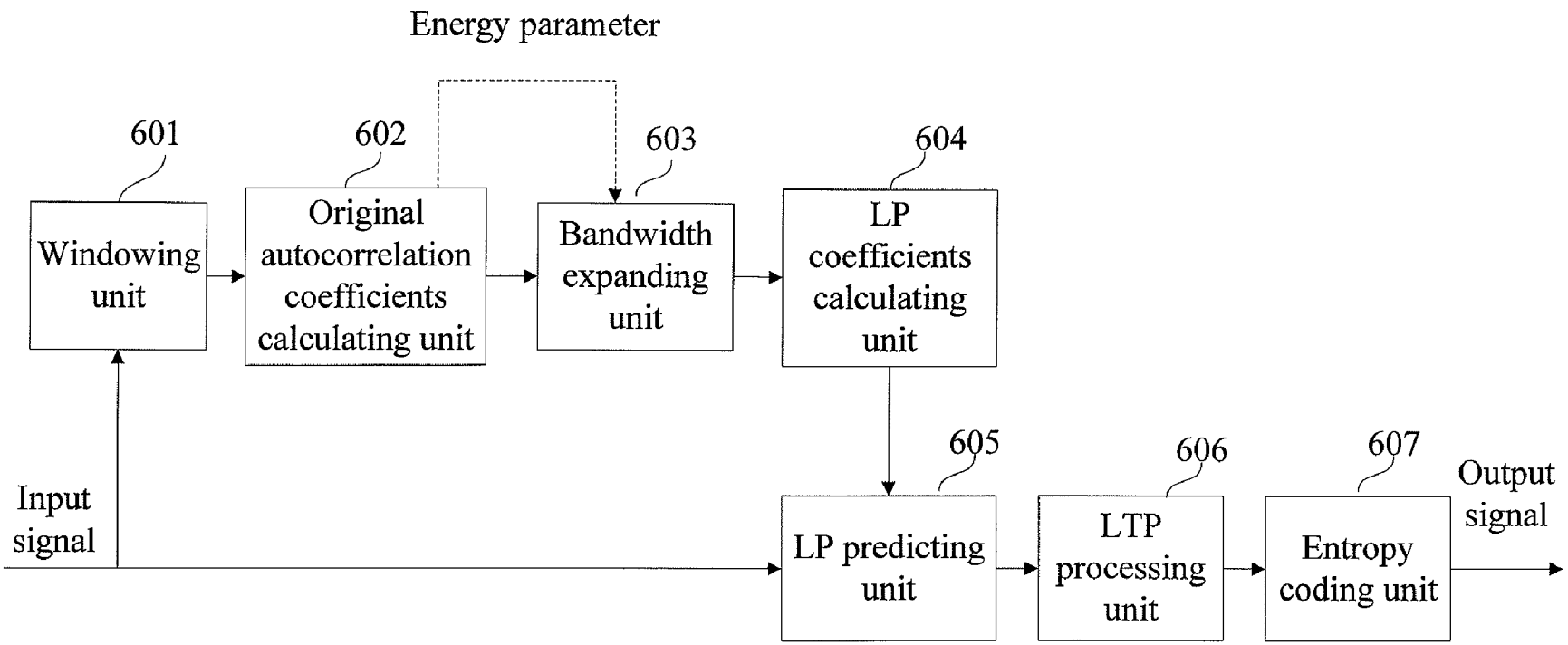
FIG. 6 shows a structure of a signal compression apparatus in the sixth embodiment of the present disclosure.

FIG. 6 shows a structure of a signal compression apparatus in the sixth embodiment of the present disclosure. The apparatus includes: a windowing unit 601, an original autocorrelation coefficients calculating unit 602, a bandwidth expanding unit 603, an LP coefficients calculating unit 604, an LP predicting unit 605, an LTP processing unit 606, and an entropy coding unit 607.

The windowing unit 601 is configured to multiply an input signal by a window function. The windowing unit 601 may be a windowing unit applied to lossy coding in the prior art. The input signal s(n) is multiplied by the window function win(n) to obtain a windowed input signal s'(n):

$s'(n)=\mathrm{win}(n)s(n)\ n=0, \ldots N-1$, where N is the frame length.

The original autocorrelation coefficients calculating unit 602 is configured to calculate the original autocorrelation coefficients of an input signal processed by the windowing unit 601, for example, through the following formula:

$$r(k)=\sum_{n=k}^{N-1} s'(n)s'(n-k)\ k=0, \ldots, p,$$

where p is the order of LP.

Figure 7:
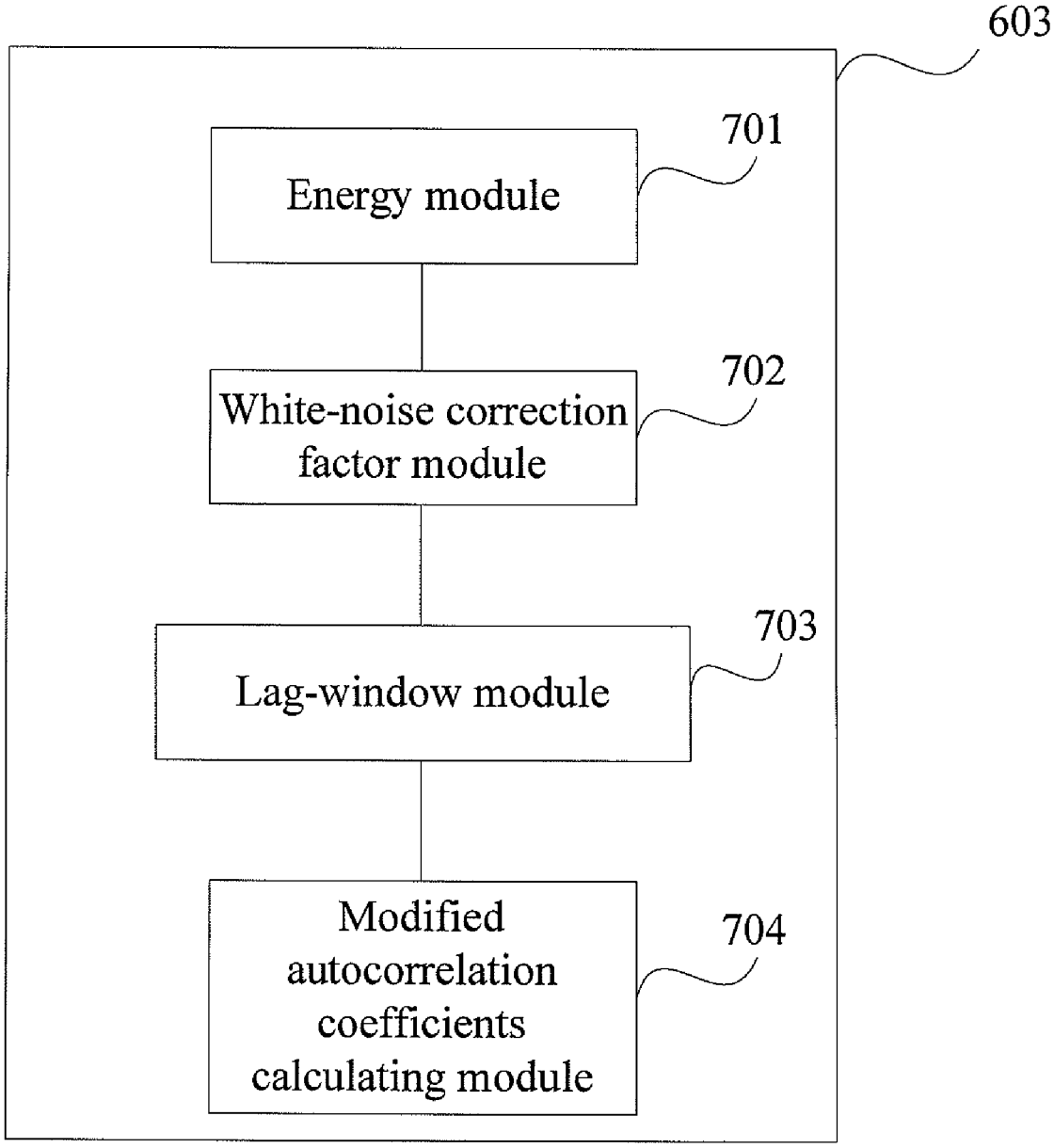
FIG. 7 shows a structure of a bandwidth expanding unit of a signal compression apparatus in the sixth embodiment of the present disclosure.

As shown in FIG. 7, the bandwidth expanding unit 603 may include an energy module 701, a white-noise correction factor module 702, a lag-window module 703, and a modified autocorrelation coefficients calculating module 704.

The energy module 701 is configured to calculate an energy parameter according to the original autocorrelation coefficients.

In some embodiments, the energy module 701 may calculate the frame average energy according to the first coefficient r(0) of the original autocorrelation coefficients:

$\mathrm{Ener_avg}=r(0)/N$, where N is the frame length.

In other embodiments, the energy module 701 may calculate the frame energy parameter Ener according to the first coefficient r(0) of the original autocorrelation coefficients:

$\mathrm{Ener}=30-\lfloor \log_2[r(0)] \rfloor$, where $\lfloor x \rfloor$ refers to rounding down, namely, $\lfloor x \rfloor=\max\{n \in \{\ldots, -2, -1, 0, 1, 2, \ldots\} | x \geqq n\}$.

The white-noise correction factor module 702 is configured to adjust the white-noise correction factor according to the energy parameter calculated by the energy module 701.

In this embodiment, an energy threshold $E_{thr}$ may be set. According to the relationship between the energy parameter E and the $E_{thr}$, the input signals are differentiated. Different adjustment functions are used to adjust the white-noise correction factor for different input signals. Specifically, different adjustment functions are used to adjust the white-noise correction factor according to different energy threshold intervals in which the energy parameter ranges:

$$win_{lag}(0)=\begin{cases} \mathrm{function_1}(r(0)); & E \in [0, E_{thr1}] \\ \mathrm{function_2}(r(0)); & E \in [E_{thr1}, E_{thr2}] \\ \vdots & \\ \mathrm{function_n}(r(0)); & E \in [E_{thr(n-1)}, E_{thrn}] \end{cases}$$

In some embodiments, the white-noise correction factor module 702 may categorize the frame signals into high-energy frame signals and low-energy frame signals according to the frame average energy Ener_avg and the energy threshold $E_{thr}$, and then adjust the white-noise correction factor $\mathrm{win}_{lag}(0)$ accordingly:

if(Ener_avg>=$E_{thr}$)

$\mathrm{win}_{lag}(0)=H+\alpha*\mathrm{Ener_avg}$;

else $\mathrm{win}_{lag}(0)=L+\beta*\mathrm{Ener_avg}$;

where $E_{thr}$, H, L, α, β are empirical constants, which may be obtained according to the specific conditions.

In other embodiments, the white-noise correction factor module 702 may categorize the frame signals into high-energy frame signals and low-energy frame signals according to the frame energy parameter Ener and the energy threshold $E_{thr}$, and then adjust the white-noise correction factor $\mathrm{win}_{lag}(0)$ accordingly:

if(Ener<$E_{thr}$)

$\mathrm{win}_{lag}(0)=L+\beta*(\mathrm{Ener}+E_{thr})$;

else $\mathrm{win}_{lag}(0)=H+\alpha*(\mathrm{Ener}+E_{thr})$;

where H, L, α, β are empirical constants, which may be obtained according to the specific conditions.

The lag-window module 703 is configured to calculate a lag-window $\mathrm{win}_{lag}(k)$ according to an expansion bandwidth $f_0$:

$$win_{lag}(k) = \exp\left[-\frac{1}{2}\left(\frac{2\pi f_0 k}{f_s}\right)^2\right] \quad k = 1, \ldots, p,$$

where $f_0$ is the expansion bandwidth such as 34 Hz; $f_s$ is a signal sampling frequency such as 8000 Hz; and p is the order of LP.

The modified autocorrelation coefficients calculating module 704 is configured to: according to the original autocorrelation coefficients r(k), an adjusted white-noise correction factor $win_{lag}(0)$ and the lag-window $win_{lag}(k)$, calculate the modified autocorrelation coefficients after the autocorrelation coefficient correction factors are adjusted:

$$r(0)' = win_{lag}(0) r(0)$$

$$r(k)' = win_{lag}(k) r(k) \quad k=1, \ldots, p,$$

The LP coefficients calculating unit 604 is configured to calculate the LP coefficients through the Levinson-Durbin algorithm according to the modified autocorrelation coefficients r(0)' . . . r(k)' adjusted by the bandwidth expanding unit 603.

The LP predicting unit 605 is configured to perform LP analysis for the input signal according to the LP coefficients calculated by the LP coefficients calculating unit 604, and calculate a residual signal.

The LTP processing unit 606 is configured to perform LTP for the residual signal output by the LP predicting unit 605.

The entropy coding unit 607 is configured to perform entropy coding for the signal which are output by the LTP processing unit 606 after the long-term prediction, and output the lossless coded bit stream of the residual signal.

The LP predicting unit 605, the LTP processing unit 606, and the entropy coding unit 607 may be the functional units applied in the prior art.

With the technical solution in this embodiment, the energy parameter that indicates the characteristics of the input signal is calculated according to the original autocorrelation coefficients. The white-noise correction factor is adjusted according to the energy parameter so that the adjusted autocorrelation coefficient correction factors are determined according to the characteristics of each frame signal. Therefore, the LP coefficients fit in with the characteristics of the signals more accurately; ill-conditioned cases are avoided; the calculated coefficients are more robust; and the calculation complexity is low.

Seventh Embodiment

Figure 8:
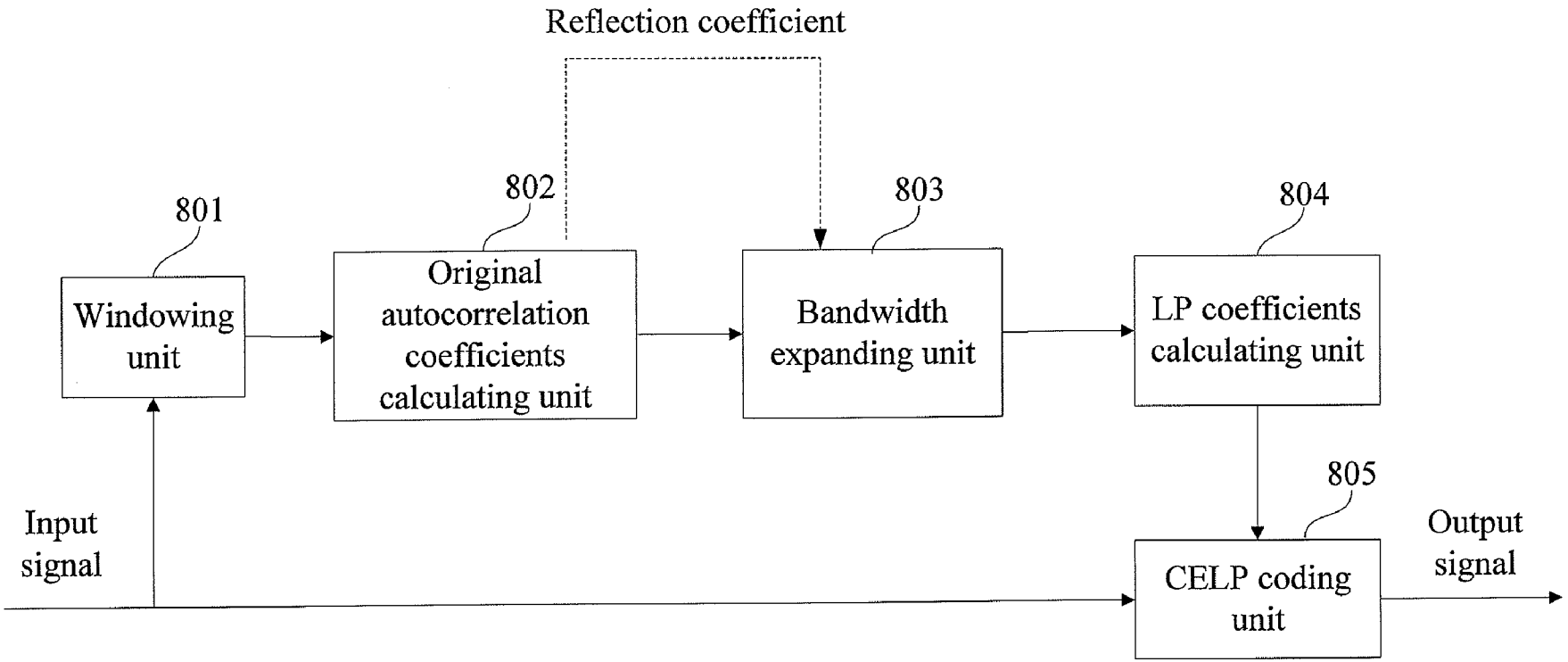
FIG. 8 shows a structure of a signal compression apparatus in the seventh embodiment of the present disclosure.

FIG. 8 shows a structure of a signal compression apparatus in the seventh embodiment of the present disclosure. The apparatus includes: a windowing unit 801, an original autocorrelation coefficients calculating unit 802, a bandwidth expanding unit 803, an LP coefficients calculating unit 804, and a CELP coding unit 805.

The windowing unit 801 is configured to multiply an input signal by a window function. The windowing unit 801 may be a windowing unit applied to lossy coding in the prior art. The input signal s(n) is multiplied by the window function win(n) to obtain a windowed input signal s' (n):

$$s'(n) = win(n) s(n) \quad n=0, \ldots N-1, \text{ where N is the frame length.}$$

The original autocorrelation coefficients calculating unit 802 is configured to calculate the original autocorrelation coefficients of an input signal processed by the windowing unit 801, for example, through the following formula:

$$r(k) = \sum_{n=k}^{N-1} s'(n) s'(n-k) \quad k = 0, \ldots, p,$$

where p is the order of LP.

Figure 9:
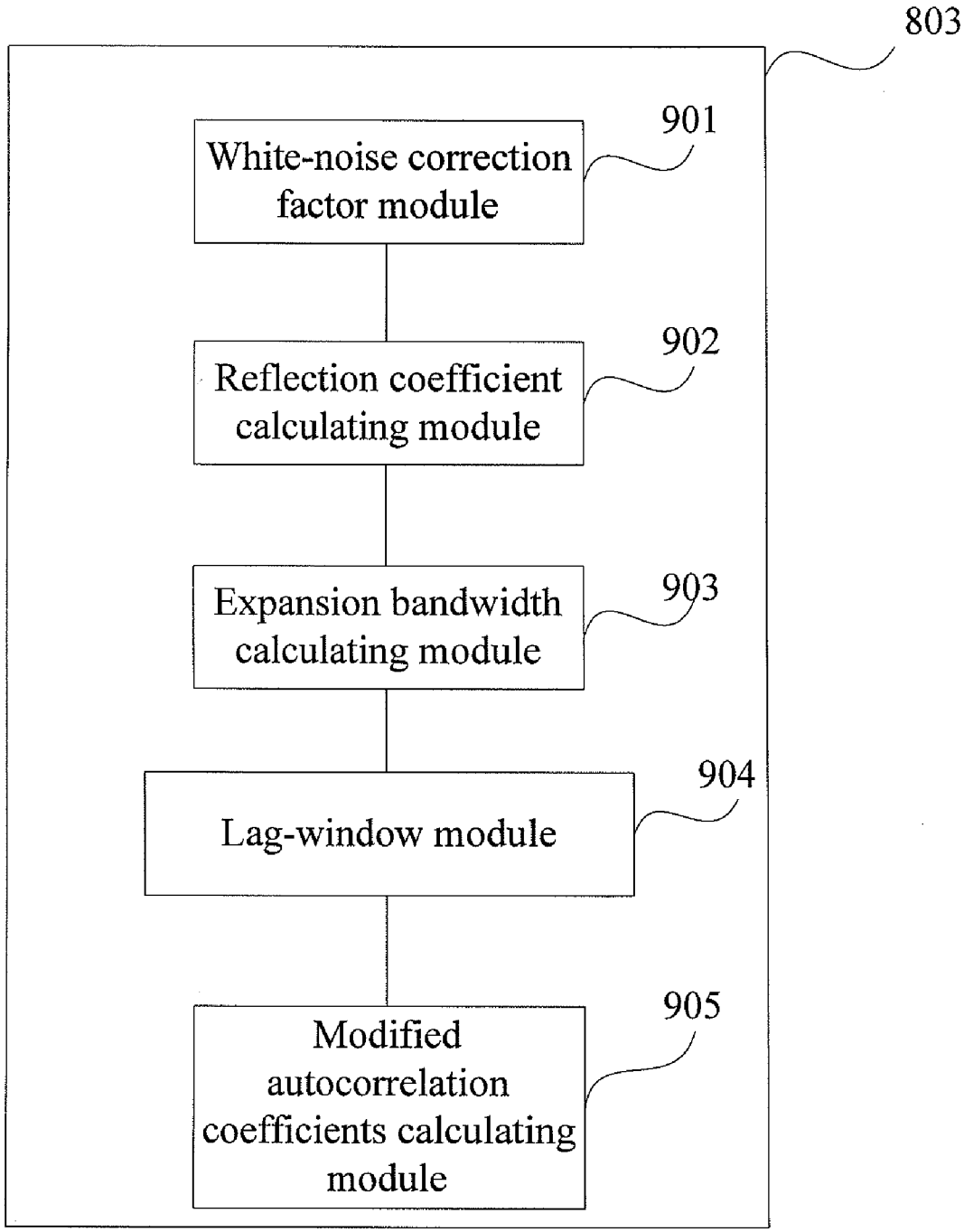
FIG. 9 shows a structure of a bandwidth expanding unit of a signal compression apparatus in the seventh embodiment of the present disclosure.

As shown in FIG. 9, the bandwidth expanding unit 803 may include a white-noise correction factor module 901, a reflection coefficient calculating module 902, an expansion bandwidth calculating module 903, a lag-window module 904, and a modified autocorrelation coefficients calculating module 905.

The white-noise correction factor module 901 is configured to determine the white-noise correction factor $win_{lag}(0)=1.0001$.

The reflection coefficient calculating module 902 is configured to calculate at least one reflection coefficient of the frame signal according to the original autocorrelation coefficients. In this embodiment, only the first reflection coefficient is calculated to simplify the calculation, but the present disclosure is not limited to calculate only the first reflection coefficient:

$$k_1 = r(1)/r(0).$$

The expansion bandwidth calculating module 903 is configured to adaptively calculate and adjust the expansion bandwidth according to the reflection coefficient $k_1$ calculated by the reflection coefficient calculating module 902:

$f_0 = F + \alpha k_1$, where F may be 60 Hz, and $\alpha$ is an empirical factor which is determined experimentally.

The lag-window module 904 is configured to calculate the lag-window according to the expansion bandwidth $f_0$ output by the expansion bandwidth calculating module 903:

$$win_{lag}(k) = \exp\left[-\frac{1}{2}\left(\frac{2\pi f_0 k}{f_s}\right)^2\right] \quad k = 1, \ldots, p$$

where $f_0$ is the expansion bandwidth calculated by the expansion bandwidth calculating module 903; $f_s$ is a signal sampling frequency such as 8000 Hz; and p is the order of LP.

The modified autocorrelation coefficients calculating module 905 is configured to: according to the original autocorrelation coefficients r(k), the white-noise correction factor $win_{lag}(0)$ and the lag-window $win_{lag}(k)$, calculate the modified autocorrelation coefficients after the autocorrelation coefficient correction factors are adjusted:

$$r(0)' = win_{lag}(0) r(0)$$

$$r(k)' = win_{lag}(k) r(k) \quad k=1, \ldots, p$$

The LP coefficients calculating unit 804 is configured to calculate the LP coefficients through the Levinson-Durbin algorithm according to the modified autocorrelation coefficients r(0)' . . . r(k)' adjusted by the bandwidth expanding unit 803.

The CELP coding unit 805 is configured to input the LP coefficients calculated by the LP coefficients calculating unit 804 and the input signal into the CELP model to obtain a coded bit stream.

Figure 10:
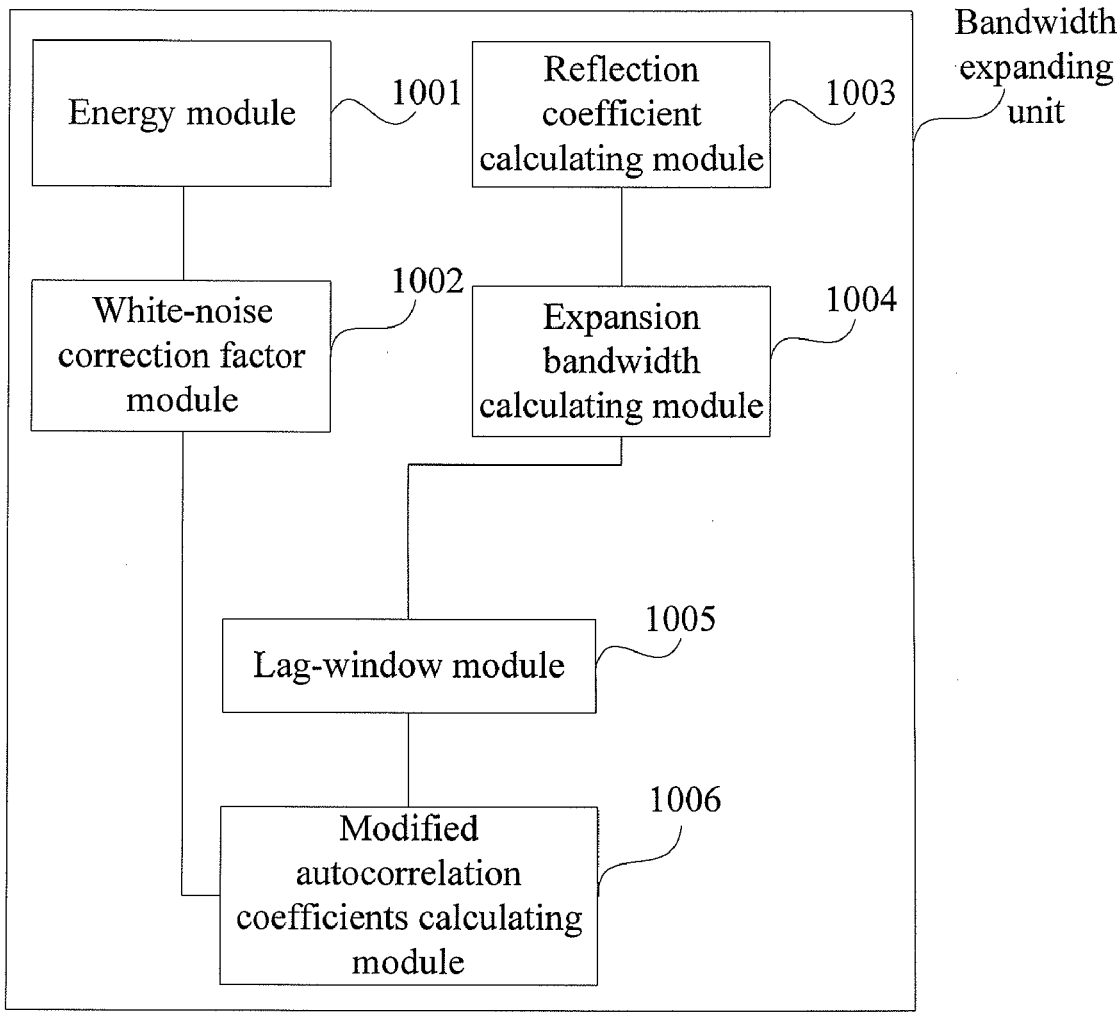
FIG. 10 shows another structure of a bandwidth expanding unit in the sixth or seventh embodiment of the present disclosure.

As shown in FIG. 10, the bandwidth expanding unit in another embodiment may include an energy module 1001, a white-noise correction factor module 1002, a reflection coefficient calculating module 1003, an expansion bandwidth calculating module 1004, a lag-window module 1005, and a modified autocorrelation coefficients calculating module

1006. The bandwidth expanding unit shown in FIG. 10 may be an alternative of the bandwidth expanding unit 603 in the sixth embodiment and the bandwidth expanding unit 803 in the seventh embodiment; the bandwidth expanding unit 603 may be applied in the seventh embodiment to replace the bandwidth expanding unit 803, and the bandwidth expanding unit 803 may be applied in the sixth embodiment to replace the bandwidth expanding unit 603.

The energy module 1001 is configured to calculate an energy parameter according to the original autocorrelation coefficients.

In some embodiments, the energy module 1001 may calculate the frame average energy according to the first coefficient r(0) of the original autocorrelation coefficients.

$$\text{Ener_avg}=r(0)/N, \text{ where N is the frame length.}$$

In other embodiments, the energy module 1001 may calculate the frame energy parameter Ener according to the first coefficient r(0) of the original autocorrelation coefficients:

$$\text{Ener}=30-\lfloor \log_2 \sqrt{r(0)} \rfloor,$$

where $\lfloor x \rfloor$ refers to rounding down, namely, $\lfloor x \rfloor=\max\{n \in \{\ldots, -2, -1, 0, 1, 2, \ldots\} | x \geqq n\}$.

The white-noise correction factor module 1002 is configured to adjust the white-noise correction factor according to the energy parameter calculated by the energy module 1001.

In this embodiment, an energy threshold $E_{thr}$ may be set. According to the relationship between the energy parameter E and the $E_{thr}$, the input signals are differentiated. Different adjustment functions are used to adjust the white-noise correction factor for different input signals. Specifically, different adjustment functions are used to adjust the white-noise correction factor according to different energy threshold intervals in which the energy parameter ranges:

$$win_{lag}(0)=\begin{cases} \text{function_1}(r(0)); & E \in [0, E_{thr1}] \\ \text{function_2}(r(0)); & E \in [E_{thr1}, E_{thr2}] \\ \vdots & \\ \text{function_n}(r(0)); & E \in [E_{thr(n-1)}, E_{thrn}] \end{cases}$$

In some embodiments, the white-noise correction factor module 1002 may categorize the frame signals into high-energy frame signals and low-energy frame signals according to the frame average energy Ener_avg and the energy threshold $E_{thr}$, and then adjust the white-noise correction factor $win_{lag}(0)$ accordingly:

$$\text{if}(\text{Ener_avg}>=E_{thr})$$

$$win_{lag}(0)=H+\alpha*\text{Ener_avg};$$

$$\text{else}$$

$$win_{lag}(0)=L+\beta*\text{Ener_avg};$$

where $E_{thr}$, H, L, α, β are empirical constants, which may be obtained according to the specific conditions.

In other embodiments, the white-noise correction factor module 1002 may categorize the frame signals into high-energy frame signals and low-energy frame signals according to the frame energy parameter Ener and the energy threshold $E_{thr}$, and then adjust the white-noise correction factor $win_{lag}(0)$ accordingly:

$$\text{if}(\text{Ener}<E_{thr})$$

$$win_{lag}(0)=L+\beta*(\text{Ener}+E_{thr});$$

$$\text{else}$$

$$win_{lag}(0)=H+\alpha*(\text{Ener}+E_{thr});$$

where H, L, α, β are empirical constants, which may be obtained according to the specific conditions.

The reflection coefficient calculating module 1003 is configured to calculate at least one reflection coefficient of the frame signal according to the original autocorrelation coefficients. In this embodiment, only the first reflection coefficient is calculated to simplify the calculation, but the present disclosure is not limited to calculate only the first reflection coefficient.

$$k_1=r(1)/r(0).$$

The expansion bandwidth calculating module 1004 is configured to adaptively calculate and adjust the expansion bandwidth according to the reflection coefficient $k_1$ calculated by the reflection coefficient calculating module 1003:

$f_0=F+\alpha k_1$, where F may be 60 Hz, and α is an empirical factor which is determined experimentally.

The lag-window module 1005 is configured to calculate the lag-window according to the expansion bandwidth $f_0$ output by the expansion bandwidth calculating module 1004:

$$win_{lag}(k)=\exp\left[-\frac{1}{2}\left(\frac{2\pi f_0 k}{f_s}\right)^2\right] \quad k=1, \ldots, p$$

where $f_0$ is the expansion bandwidth calculated by the expansion bandwidth calculating module 1004; $f_s$ is a signal sampling frequency such as 8000 Hz; and p is the order of LP.

The modified autocorrelation coefficients calculating module 1006 is configured to: according to the original autocorrelation coefficients r(k), the white-noise correction factor $win_{lag}(0)$ and the lag-window $win_{lag}(k)$, calculate the modified autocorrelation coefficients after the autocorrelation coefficient correction factors are adjusted:

$$r(0)'=win_{lag}(0)r(0)$$

$$r(k)'=win_{lag}(k)r(k) \quad k=1, \ldots, p$$

With the technical solution in the foregoing embodiment, the energy parameter and the reflection coefficient that indicates the characteristics of the input signal are calculated according to the original autocorrelation coefficients, the white-noise correction factor is adjusted according to the energy parameter. The expansion bandwidth is determined according to the reflection coefficient, and the lag-window is adjusted according to the determined expansion bandwidth. In this way the adjusted autocorrelation coefficient correction factors are determined according to the characteristics of each frame signal. Therefore, the LP coefficients fit in with the characteristics of the signals more accurately; ill-conditioned cases are avoided; the calculated coefficients are more robust; and the calculation complexity is low.

In the embodiments of the present disclosure, the LP coefficients are calculated according to the modified autocorrelation coefficients through many algorithms such as the Levinson-Durbin algorithm, covariance method, and lattice method. The foregoing embodiments take the Levinson-Durbin algorithm as an example, but the present disclosure does not limit the algorithm.

In the embodiments of the present disclosure, multiple reflection coefficients $k_i$ of the windowed input signal may be calculated according to the original autocorrelation coefficients, and then the expansion bandwidth is calculated through one or more reflection coefficients. In this case, the calculation mode of the expansion bandwidth may change accordingly. That is, multiple reflection coefficients are used together with multiple regulating expansion factors to generate a new expression between the reflection coefficient and the expansion bandwidth. The embodiments of the present disclosure give an exemplary expression between the reflection coefficient and the expansion bandwidth, but those skilled in the art may derive various expressions between the reflection coefficient and the expansion bandwidth from the embodiments described herein without creative work. The present disclosure does not limit the expression between the reflection coefficient and the expansion bandwidth. Specifically, the regulating expansion factor corresponding to each reflection coefficient may be obtained through training by using representative training data, and the training is benchmarked against the final coder performance, and then various expressions between the reflection coefficient and the expansion bandwidth are constructed.

It is understandable to those skilled in the art that all or part of the steps of the foregoing embodiments may be implemented by hardware instructed by a computer program. The program may be stored in a computer-readable storage medium. When being executed, the program performs the processes covered in the foregoing embodiments. The storage medium may be a magnetic disk, a compact disk, a Read-Only Memory (ROM), or a Random Access Memory (RAM).

Detailed above are the objectives, technical solution and benefits of the embodiments of the present disclosure. Although the disclosure has been described through several exemplary embodiments, the disclosure is not limited to such embodiments. It is apparent that those skilled in the art can make modifications and variations to the disclosure without departing from the scope of the disclosure. The disclosure is intended to cover the modifications and variations provided that they fall in the scope of protection defined by the following claims or their equivalents.

What is claimed is:

1. An audio signal compression method in a communications device including a processor, the method comprising:

multiplying, by the processor, an input audio signal by a window function for obtaining a windowed audio signal;

calculating, by the processor, an original autocorrelation coefficient particular to the windowed audio signal, the windowed audio signal having an autocorrelation coefficient correction factor;

adjusting, by the processor, the autocorrelation coefficient correction factor in accordance with the original autocorrelation coefficient for obtaining an adjusted autocorrelation coefficient correction factor;

modifying, by the processor, the original autocorrelation coefficient in accordance with the adjusted autocorrelation coefficient correction factor for obtaining a modified autocorrelation coefficient;

calculating, by the processor, a linear prediction coefficient in accordance with the modified autocorrelation coefficient;

coding, by the processor, the windowed audio signal in accordance with the linear prediction coefficients for generating an audio coded bit stream; and outputting, by the processor, the audio coded bit stream.

2. The audio signal compression method according to claim 1, wherein the autocorrelation coefficient correction factor comprises a white-noise correction factor and a lag-window, and wherein the adjusting, by the processor, the autocorrelation coefficient correction factor in accordance with the original autocorrelation coefficient comprises:

calculating, by the processor, an energy parameter in accordance with the original autocorrelation coefficient adjusting, by the processor, the white-noise correction factor in accordance with the energy parameter;

calculating, by the processor, the lag-window in accordance with an expansion bandwidth.

3. The audio signal compression method according to claim 1, wherein the adjusting, by the processor, the autocorrelation coefficient correction factor in accordance with the original autocorrelation coefficient comprises:

calculating an energy parameter in accordance with to the original autocorrelation coefficient;

adjusting a white-noise correction factor in accordance with the energy parameter;

calculating at least one reflection coefficient of the windowed audio input signal in accordance with the original autocorrelation coefficient;

adjusting an expansion bandwidth in accordance with the at least one reflection coefficient; and calculating a lag-window in accordance with the adjusted expansion bandwidth.

4. The audio signal compression method according to claim 1, wherein the adjusting, by the processor, the autocorrelation coefficient correction factor in accordance with the original autocorrelation coefficient comprises:

calculating, by the processor, at least one reflection coefficient of the windowed audio signal in accordance with the original autocorrelation coefficient;

adjusting an expansion bandwidth according to the at least one reflection coefficient; and calculating a lag-window in accordance with an adjusted expansion bandwidth.

5. An audio signal compression method in a communications device including a processor, the method comprising:

multiplying, by the processor, an input audio signal by a window function for obtaining a windowed audio signal;

calculating, by the processor, an original autocorrelation coefficient of the windowed audio signal, the windowed audio signal having an autocorrelation coefficient correction factor, wherein the autocorrelation coefficient correction factor comprises a white-noise correction factor;

adjusting, by the processor, the autocorrelation coefficient correction factor in accordance with the original autocorrelation coefficient for obtaining an adjusted autocorrelation coefficient correction factor;

modifying, by the processor, the original autocorrelation coefficient in accordance with the adjusted autocorrelation coefficient correction factor for obtaining a modified autocorrelation coefficient;

calculating, by the processor, a linear prediction coefficient in accordance with the modified autocorrelation coefficient;

coding, by the processor, the windowed audio signal in accordance with the linear prediction coefficients for generating an audio coded bit stream; and outputting, by the processor, the audio coded bit stream, wherein the adjusting, by the processor, the autocorrelation coefficient correction factor in accordance with the original autocorrelation coefficient comprises:

calculating, by the processor, an energy parameter in accordance with the original autocorrelation coefficient;

adjusting the white-noise correction factor in accordance with the energy parameter; and calculating, by the processor, the lag-window in accordance with an expansion bandwidth, wherein the calculating, by the processor, the energy parameter in accordance with the original autocorrelation coefficient comprises:

calculating, by the processor, the energy parameter in accordance with the first coefficient r(0) of the original autocorrelation coefficient, and wherein the adjusting, by the processor, the white-noise correction factor in accordance with the energy parameter comprises:

using, by the processor, different adjustment functions to adjust the white-noise correction factor in accordance with different energy threshold intervals in which the energy parameter ranges, that is, $$win_{lag}(0) = \begin{cases} \text{function_1}(r(0)); & E \in [0, E_{thr1}] \\ \text{function_2}(r(0)); & E \in [E_{thr1}, E_{thr2}] \\ \vdots & \\ \text{function_n}(r(0)); & E \in [E_{thr(n-1)}, E_{thrn}], \end{cases}$$

where $win_{lag}$ (0) is the white-noise correction factor, E is the energy parameter, and $E_{thr}$ is the energy threshold.

6. An audio signal compression method in a communications device including a processor, the method comprising:

multiplying, by the processor, an input audio signal by a window function for obtaining a windowed audio signal;

calculating, by the processor, an original autocorrelation coefficient of the windowed audio signal, the windowed audio signal having an autocorrelation coefficient correction factor, wherein the autocorrelation coefficient correction factor comprises a white-noise correction factor;

adjusting, by the processor, the autocorrelation coefficient correction factor in accordance with the original autocorrelation coefficient for obtaining an adjusted autocorrelation coefficient correction factor;

modifying, by the processor, the original autocorrelation coefficient in accordance with the adjusted autocorrelation coefficient correction factor for obtaining a modified autocorrelation coefficient;

calculating, by the processor, a linear prediction coefficient in accordance with the modified autocorrelation coefficient;

coding, by the processor, the windowed audio signal in accordance with the linear prediction coefficients for generating an audio coded bit stream; and outputting, by the processor, the audio coded bit stream, wherein the adjusting, by the processor, the autocorrelation coefficient correction factor in accordance with the original autocorrelation coefficient comprises:

calculating, by the processor, an energy parameter in accordance with the original autocorrelation coefficient;

adjusting the white-noise correction factor in accordance with the energy parameter; and calculating, by the processor, the lag-window in accordance with an expansion bandwidth, wherein the calculating, by the processor, the energy parameter in accordance with the original autocorrelation coefficient comprises:

calculating, by the processor, a frame energy parameter Ener in accordance with the first coefficient r(0) of the original autocorrelation coefficient through the formulation Ener=30−$\lfloor \log_2[r(0)] \rfloor$, and wherein the adjusting, by the processor, the white-noise correction factor in accordance with the energy parameter comprises one of:

adjusting, by the processor, the white-noise correction factor $win_{lag}$ (0) through the formulation $win_{lag}(0)$= H+α*(Ener+$E_{thr}$) if the frame energy parameter Ener is greater than or equal to the energy threshold $E_{thr}$; and adjusting, by the processor, the white-noise correction factor $win_{lag}$ (0) through the formulation $win_{lag}$ (0)=L+β*(Ener+$E_{thr}$) if the frame energy parameter Ener is less than the energy threshold $E_{thr}$; where H, L, α, β are empirical constants.

7. An audio signal compression method in a communications device including a processor, the method comprising:

multiplying, by the processor, an input audio signal by a window function for obtaining a windowed audio signal;

calculating, by the processor, an original autocorrelation coefficient of the windowed audio signal, the windowed audio signal having an autocorrelation coefficient correction factor, wherein the autocorrelation coefficient correction factor comprises a white-noise correction factor;

adjusting, by the processor, the autocorrelation coefficient correction factor in accordance with the original autocorrelation coefficient for obtaining an adjusted autocorrelation coefficient correction factor;

modifying, by the processor, the original autocorrelation coefficient in accordance with the adjusted autocorrelation coefficient correction factor for obtaining a modified autocorrelation coefficient;

calculating, by the processor, a linear prediction coefficient in accordance with the modified autocorrelation coefficient;

coding, by the processor, the windowed audio signal in accordance with the linear prediction coefficients for generating an audio coded bit stream; and outputting, by the processor, the audio coded bit stream, wherein the adjusting, by the processor, the autocorrelation coefficient correction factor in accordance with the original autocorrelation coefficient comprises:

calculating, by the processor, an energy parameter in accordance with the original autocorrelation coefficient;

adjusting the white-noise correction factor in accordance with the energy parameter; and calculating, by the processor, the lag-window in accordance with an expansion bandwidth, wherein the calculating, by the processor, the energy parameter in accordance with the original autocorrelation coefficient comprises:

calculating, by the processor, a frame average energy Ener_avg in accordance with the first coefficient r(0) of the original autocorrelation coefficients and a frame length N through the formulation Ener_avg=r (0)/N; and wherein the adjusting, by the processor, the white-noise correction factor in accordance with the energy parameter comprises one of:

adjusting, by the processor, the white-noise correction factor $win_{lag}$ (0) through the formulation $win_{lag}$ (0)=H+α*Ener_avg if the frame average energy Ener_ avg is greater than or equal to the energy threshold $E_{thr}$; and adjusting, by the processor, the white-noise correction factor $win_{lag}$ (0) through the formulation $win_{lag}(0)=L+\beta*Ener_avg$ if the frame average energy Ener_avg is less than the energy threshold $E_{thr}$; where H, L, α, β are empirical constants.

8. An audio signal compression method in a communications device including a processor, the method comprising:

multiplying, by the processor, an input audio signal by a window function for obtaining a windowed audio signal;

calculating, by the processor, an original autocorrelation coefficient of the windowed audio signal, the windowed audio signal having an autocorrelation coefficient correction factor, wherein the autocorrelation coefficient correction factor comprises a white-noise correction factor;

adjusting, by the processor, the autocorrelation coefficient correction factor in accordance with the original autocorrelation coefficient for obtaining an adjusted autocorrelation coefficient correction factor;

modifying, by the processor, the original autocorrelation coefficient in accordance with the adjusted autocorrelation coefficient correction factor for obtaining a modified autocorrelation coefficient;

calculating, by the processor, a linear prediction coefficient in accordance with the modified autocorrelation coefficient;

coding, by the processor, the windowed audio signal in accordance with the linear prediction coefficients for generating an audio coded bit stream; and outputting, by the processor, the audio coded bit stream, wherein the adjusting, by the processor, the autocorrelation coefficient correction factor in accordance with the original autocorrelation coefficient comprises:

calculating an energy parameter in accordance with the original autocorrelation coefficient;

adjusting a white-noise correction factor in accordance with the energy parameter;

calculating at least one reflection coefficient of the windowed audio signal in accordance with the original autocorrelation coefficient;

adjusting an expansion bandwidth in accordance with the at least one reflection coefficient; and calculating a lag-window in accordance with the adjusted expansion bandwidth, and wherein the calculating, by the processor, the energy parameter in accordance with the original autocorrelation coefficient comprises:

calculating, by the processor, the energy parameter in accordance with the first coefficient r(0) of the original autocorrelation coefficient; and wherein the adjusting, by the processor, the white-noise correction factor in accordance with the energy parameter comprises:

using different adjustment functions to adjust the white-noise correction factor in accordance with different energy threshold intervals in which the energy parameter ranges, that is, $$win_{lag}(0)=\begin{cases}\text{function_1}(r(0)); & E\in[0,E_{thr1}]\\ \text{function_2}(r(0)); & E\in[E_{thr1},E_{thr2}]\\ \vdots & \\ \text{function_n}(r(0)); & E\in[E_{thr(n-1)},E_{thrn}],\end{cases}$$

where $win_{lag}$ (0) is the white-noise correction factor, E is the energy parameter, and $E_{thr}$ is the energy threshold.

9. An audio signal compression method in a communications device including a processor, the method comprising:

multiplying, by the processor, an input audio signal by a window function for obtaining a windowed audio signal;

calculating, by the processor, an original autocorrelation coefficient of the windowed audio signal, the windowed audio signal having an autocorrelation coefficient correction factor, wherein the autocorrelation coefficient correction factor comprises a white-noise correction factor;

adjusting, by the processor, the autocorrelation coefficient correction factor in accordance with the original autocorrelation coefficient for obtaining an adjusted autocorrelation coefficient correction factor;

modifying, by the processor, the original autocorrelation coefficient in accordance with the adjusted autocorrelation coefficient correction factor for obtaining a modified autocorrelation coefficient;

calculating, by the processor, a linear prediction coefficient in accordance with the modified autocorrelation coefficient;

coding, by the processor, the windowed audio signal in accordance with the linear prediction coefficients for generating an audio coded bit stream; and outputting, by the processor, the audio coded bit stream, wherein the adjusting, by the processor, the autocorrelation coefficient correction factor in accordance with the original autocorrelation coefficient comprises:

calculating an energy parameter in accordance with the original autocorrelation coefficient;

adjusting a white-noise correction factor in accordance with the energy parameter;

calculating at least one reflection coefficient of the windowed audio signal in accordance with the original autocorrelation coefficient;

adjusting an expansion bandwidth in accordance with the at least one reflection coefficient; and calculating a lag-window in accordance with the adjusted expansion bandwidth, and wherein the calculating, by the processor, the energy parameter in accordance with the original autocorrelation coefficient comprises:

calculating, by the processor, a frame energy parameter Ener in accordance with the first coefficient r(0) of the original autocorrelation coefficients through the formulation $Ener=30-\lfloor\log_2[r(0)]\rfloor$; and wherein the adjusting, by the processor, the white-noise correction factor in accordance with the energy parameter comprises one of:

adjusting, by the processor, the white-noise correction factor $win_{lag}$ (0) through the formulation $win_{lag}(0)=H+\alpha*(Ener+E_{thr})$ if the frame energy parameter Ener is greater than or equal to the energy threshold $E_{thr}$; and adjusting, by the processor, the white-noise correction factor $win_{lag}$ (0) through the formulation $win_{lag}(0)=L+\beta*(Ener+E_{thr})$ if the frame energy parameter Ener is less than the energy threshold $E_{thr}$; where H, L, α, β are empirical constants.

10. An audio signal compression method in a communications device including a processor, the method comprising:

multiplying, by the processor, an input audio signal by a window function for obtaining a windowed audio signal;

calculating, by the processor, an original autocorrelation coefficient of the windowed audio signal, the windowed audio signal having an autocorrelation coefficient correction factor, wherein the autocorrelation coefficient correction factor comprises a white-noise correction factor;

adjusting, by the processor, the autocorrelation coefficient correction factor in accordance with the original autocorrelation coefficient for obtaining an adjusted autocorrelation coefficient correction factor;

modifying, by the processor, the original autocorrelation coefficient in accordance with the adjusted autocorrelation coefficient correction factor for obtaining a modified autocorrelation coefficient;

calculating, by the processor, a linear prediction coefficient in accordance with the modified autocorrelation coefficient;

coding, by the processor, the windowed audio signal in accordance with the linear prediction coefficients for generating an audio coded bit stream; and outputting, by the processor, the audio coded bit stream, wherein the adjusting, by the processor, the autocorrelation coefficient correction factor in accordance with the original autocorrelation coefficient comprises:

calculating an energy parameter in accordance with the original autocorrelation coefficient;

adjusting a white-noise correction factor in accordance with the energy parameter;

calculating at least one reflection coefficient of the windowed audio signal in accordance with the original autocorrelation coefficient;

adjusting an expansion bandwidth in accordance with the at least one reflection coefficient; and calculating a lag-window in accordance with the adjusted expansion bandwidth, and wherein the calculating, by the processor, the energy parameter in accordance with the original autocorrelation coefficient comprises:

calculating, by the processor, a frame average energy Ener_avg according to the first coefficient r(0) of the original autocorrelation coefficients and a frame length N through the formulation Ener_avg=r(0)/N; and wherein the adjusting, by the processor, the white-noise correction factor in accordance with the energy parameter comprises one of:

adjusting, by processor, the white-noise correction factor $win_{lag}(0)$ through the formulation $win_{lag}(0)=H+\alpha*Ener_avg$ if the frame average energy Ener_avg is greater than or equal to the energy threshold $E_{thr}$; and adjusting, by the processor, the white-noise correction factor $win_{lag}(0)$ through the formulation $win_{lag}(0)=L+\beta*Ener_avg$ if the frame average energy Ener_avg is less than the energy threshold $E_{thr}$; where H, L, α, β are empirical constants.

11. An audio signal compression method in a communications device including a processor, the method comprising:

multiplying, by the processor, an input audio signal by a window function for obtaining a windowed audio signal;

calculating, by the processor, an original autocorrelation coefficient of the windowed audio signal, the windowed audio signal having an autocorrelation coefficient correction factor, wherein the autocorrelation coefficient correction factor comprises a white-noise correction factor;

adjusting, by the processor, the autocorrelation coefficient correction factor in accordance with the original autocorrelation coefficient for obtaining an adjusted autocorrelation coefficient correction factor;

modifying, by the processor, the original autocorrelation coefficient in accordance with the adjusted autocorrelation coefficient correction factor for obtaining a modified autocorrelation coefficient;

calculating, by the processor, a linear prediction coefficient in accordance with the modified autocorrelation coefficient;

coding, by the processor, the windowed audio signal in accordance with the linear prediction coefficients for generating an audio coded bit stream; and outputting, by the processor, the audio coded bit stream, wherein the adjusting, by the processor, the autocorrelation coefficient correction factor in accordance with the original autocorrelation coefficient comprises:

calculating an energy parameter in accordance with the original autocorrelation coefficient;

adjusting a white-noise correction factor in accordance with the energy parameter;

calculating at least one reflection coefficient of the windowed audio signal in accordance with the original autocorrelation coefficient;

adjusting an expansion bandwidth in accordance with the at least one reflection coefficient; and calculating a lag-window in accordance with the adjusted expansion bandwidth, and wherein the calculating, by the processor, the at least one reflection coefficient of the windowed audio signal in accordance with the original autocorrelation coefficient comprises:

calculating the first reflection coefficient $k_1$ through the formulation $k_1=r(1)/r(0)$, where r(0) is the first coefficient of the original autocorrelation coefficients, r(1) is the second coefficient of the original autocorrelation coefficients; and wherein the adjusting, by the processor, the expansion bandwidth in accordance with the at least one reflection coefficient comprises:

calculating, by the processor, the expansion bandwidth $f_0$ through the formulation $f_0=F+\alpha k_1$, where F and α are empirical constants.

12. An audio signal compression method in a communications device including a processor, the method comprising:

multiplying, by the processor, an input audio signal by a window function for obtaining a windowed audio signal;

calculating, by the processor, original autocorrelation coefficients particular to the windowed audio signal;

calculating, by the processor, an energy parameter in accordance with according to a first coefficient of the original autocorrelation coefficients;

adjusting, by the processor, a white-noise correction factor in accordance with the energy parameter;

calculating, by the processor, a lag-window in accordance with an expansion bandwidth;

calculating, by the processor, modified autocorrelation coefficients in accordance with the original autocorrelation coefficients, an adjusted white-noise correction factor, and the lag-window;

calculating, by the processor, linear prediction coefficients in accordance with the modified autocorrelation coefficients; and performing, by the processor, linear prediction for the windowed audio signal in accordance with the linear prediction coefficients;

calculating, by the processor, a residual signal;

coding, by the processor, the residual signal for generating an audio coded bit stream; and outputting, by the processor, the audio coded bit stream.

13. An audio signal compression method in a communications device including a processor, the method comprising:

multiplying, by the processor, an input audio signal by a window function for obtaining a windowed audio signal;

calculating, by the processor, original autocorrelation coefficients of the windowed audio signal;

calculating, by the processor, an energy parameter in accordance with a first coefficient of the original autocorrelation coefficients;

adjusting, by the processor, a white-noise correction factor in accordance with the energy parameter;

calculating, by the processor, a lag-window in accordance with an expansion bandwidth;

calculating, by the processor, modified autocorrelation coefficients in accordance with the original autocorrelation coefficients, an adjusted white-noise correction factor, and the lag-window;

calculating, by the processor, linear prediction coefficients in accordance with the modified autocorrelation coefficients; and performing, by the processor, linear prediction for the windowed audio signal in accordance with the linear prediction coefficients;

calculating, by the processor, a residual signal;

coding, by the processor, the residual signal for generating an audio coded bit stream; and outputting, by the processor, the audio coded bit stream, wherein the calculating, by the processor, the energy parameter in accordance with the first coefficient of the original autocorrelation coefficients comprises:

calculating, by the processor, a frame energy parameter Ener in accordance with the first coefficient r(0) of the original autocorrelation coefficients through the formulation $Ener=30-\lfloor \log_2[r(0)] \rfloor$; and wherein the adjusting, by the processor, the white-noise correction factor in accordance with the energy parameter comprises one of:

adjusting, by the processor, the white-noise correction factor $win_{lag}$ (0) through the formulation $win_{lag}(0)=H+\alpha*(Ener+E_{thr})$ if the frame energy parameter Ener is greater than or equal to the energy threshold $E_{thr}$; and adjusting, by the processor, the white-noise correction factor $win_{lag}$ (0) through the formulation $win_{lag}(0)=L+\beta*(Ener+E_{thr})$ if the frame energy parameter Ener is less than the energy threshold $E_{thr}$; wherein H, L, α, β are empirical constants.

14. An audio signal compression method in a communications device including a processor, the method comprising:

multiplying, by the processor, an input audio signal by a window function for obtaining a windowed audio signal;

calculating, by the processor, original autocorrelation coefficients of the windowed audio signal;

calculating, by the processor, an energy parameter in accordance with a first coefficient of the original autocorrelation coefficients;

adjusting, by the processor, a white-noise correction factor in accordance with the energy parameter;

calculating, by the processor, a lag-window in accordance with an expansion bandwidth;

calculating, by the processor, modified autocorrelation coefficients in accordance with the original autocorrelation coefficients, an adjusted white-noise correction factor, and the lag-window;

calculating, by the processor, linear prediction coefficients in accordance with the modified autocorrelation coefficients; and performing, by the processor, linear prediction for the windowed audio signal in accordance with the linear prediction coefficients;

calculating, by the processor, a residual signal;

coding, by the processor, the residual signal for generating an audio coded bit stream; and outputting, by the processor, the audio coded bit stream, wherein the calculating, by the processor, the energy parameter in accordance with the first coefficient of the original autocorrelation coefficients comprises:

calculating, by the processor, a frame average energy Ener_avg in accordance with the first coefficient r(0) of the original autocorrelation coefficients and a frame length N through the formulation Ener_avg=r(0)/N; and wherein the adjusting, by the processor, the white-noise correction factor in accordance with the energy parameter comprises one of:

adjusting, by the processor, the white-noise correction factor $win_{lag}$ (0) through the formulation $win_{lag}(0)=H+\alpha*Ener_avg$ if the frame average energy Ener_avg is greater than or equal to the energy threshold $E_{thr}$; and adjusting, by the processor, the white-noise correction factor $win_{lag}$ (0) through the formulation $win_{lag}(0)=L+\beta*Ener_avg$ if the frame average energy Ener_avg is less than the energy threshold $E_{thr}$; where H, L, α, β are empirical constants.

15. An audio signal compression apparatus, comprising:

a windowing unit, configured to multiply an input audio signal by a window function for obtaining a windowed audio signal;

an original autocorrelation coefficients calculating unit, configured to calculate an original autocorrelation coefficient particular to the windowed audio signal processed by the windowing unit, wherein the windowed audio signal has an autocorrelation coefficient correction factor;

a bandwidth expanding unit, configured to adjust the autocorrelation coefficient correction factor in accordance with the original autocorrelation coefficient calculated by the original autocorrelation coefficients calculating unit, and calculate a modified autocorrelation coefficient in accordance with the adjusted autocorrelation coefficient correction factor;

a linear prediction coefficients calculating unit, configured to calculate the linear prediction coefficients in accordance with the modified autocorrelation coefficient calculated by the bandwidth expanding unit; and a compressing unit, configured to code the windowed audio signal in accordance with the linear prediction coefficients calculated by the linear prediction coefficients calculating unit for generating an audio coded bit stream, and output the audio coded bit stream.

16. The audio signal compression apparatus according to claim 15, wherein the bandwidth expanding unit comprises:

an energy module, configured to calculate the energy parameter in accordance with the original autocorrelation coefficient;

a white-noise correction factor module, configured to adjust the white-noise correction factor in accordance with the energy parameter calculated by the energy module;

a reflection coefficient calculating module, configured to calculate at least one reflection coefficient of the windowed audio signal in accordance with the original autocorrelation coefficient;

and a modified autocorrelation coefficients calculating module, configured to calculate the modified autocorrelation coefficient in accordance with the original autocorrelation coefficient, and an adjusted white-noise correction factor.

17. The audio signal compression apparatus according to claim 15, wherein the bandwidth expanding unit comprises:

an energy module, configured to calculate the energy parameter in accordance with the original autocorrelation coefficient;

a white-noise correction factor module, configured to adjust the white-noise correction factor in accordance with the energy parameter calculated by the energy module;

a lag-window module, configured to calculate the lag-window in accordance with an expansion bandwidth; and a modified autocorrelation coefficients calculating module, configured to calculate the modified autocorrelation coefficients in accordance with the original autocorrelation coefficient, an adjusted white-noise correction factor, and the lag-window.

18. The signal compression apparatus according to claim 15, wherein the bandwidth expanding unit comprises:

a white-noise correction factor module, configured to determine the white-noise correction factor;

a reflection coefficient calculating module, configured to calculate at least one reflection coefficient of the windowed audio signal in accordance with the original autocorrelation coefficient;

an expansion bandwidth calculating module, configured to adjust the expansion bandwidth in accordance with the at least one reflection coefficient calculated by the reflection coefficient calculating module;

a lag-window module, configured to calculate the lag-window in accordance with an adjusted expansion bandwidth output by the expansion bandwidth calculating module; and a modified autocorrelation coefficients calculating module, configured to calculate the modified autocorrelation coefficient in accordance with the original autocorrelation coefficient, the white-noise correction factor, and the lag-window.

19. The audio signal compression apparatus according to claim 15, further comprising:

a preprocessing unit, configured to preprocess the input audio signal for different types of compression, and send a preprocessed input audio signal to the windowing unit to make the input audio signal more suitable for being processed by subsequent modules.

20. A communications device comprising:

a processor; and a non-transitory computer readable storage medium storing programming for execution by the processor, the programming including instructions to:

multiply an input audio signal by a window function for obtaining a windowed audio signal;

calculate an original autocorrelation coefficient particular to the windowed audio signal, the windowed audio signal having an autocorrelation coefficient correction factor;

adjust the autocorrelation coefficient correction factor in accordance with the original autocorrelation coefficient for obtaining an adjusted autocorrelation coefficient correction factor;

modify the original autocorrelation coefficient in accordance with the adjusted autocorrelation coefficient correction factor for obtaining a modified autocorrelation coefficient;

calculate linear prediction coefficient in accordance with the modified autocorrelation coefficient; and code the windowed audio signal in accordance with the linear prediction coefficients for generating an audio coded stream; and output the audio coded bit stream.

* * * * *